US007269101B2

(12) United States Patent
Watanabe et al.

(10) Patent No.: US 7,269,101 B2
(45) Date of Patent: Sep. 11, 2007

(54) MULTIFUNCTION TIMEPIECE HAVING FAN SHAPE MOVING HAND MECHANISM INCLUDING RETURN SPRING AND FAN SHAPE MOVING HAND TRAIN WHEEL APPARATUS

(75) Inventors: Mamoru Watanabe, Chiba (JP); Takeshi Tokoro, Chiba (JP); Kei Hirano, Chiba (JP)

(73) Assignee: Seiko Instruments Inc. (JP)

( * ) Notice: Subject to any disclaimer, the term of this patent is extended or adjusted under 35 U.S.C. 154(b) by 89 days.

(21) Appl. No.: 11/297,128

(22) Filed: Dec. 8, 2005

(65) Prior Publication Data

US 2006/0126436 A1 Jun. 15, 2006

(30) Foreign Application Priority Data

Dec. 15, 2004 (JP) ..... 2004-362812

(51) Int. Cl.
*G04B 19/24* (2006.01)

(52) U.S. Cl. ..... 368/28; 368/223

(58) Field of Classification Search ..... 368/28, 368/223, 31–38, 80
See application file for complete search history.

(56) References Cited

U.S. PATENT DOCUMENTS 3,732,686 A * 5/1973 Zaugg ..... 368/37
4,623,261 A * 11/1986 Muto ..... 368/80
5,379,272 A * 1/1995 Parmigiani ..... 368/37
5,956,294 A * 9/1999 Takizawa et al. ..... 368/37
6,370,087 B1 * 4/2002 Akahane et al. ..... 368/110
7,065,005 B2 * 6/2006 Rochat ..... 368/72
7,167,416 B2 * 1/2007 Krishnamani ..... 368/28
7,170,826 B2 * 1/2007 Furukawa et al. ..... 368/80
2004/0105346 A1 * 6/2004 Lang ..... 368/80
2004/0218473 A1 * 11/2004 Takahashi et al. ..... 368/37
2006/0140057 A1 * 6/2006 Hirano et al. ..... 368/28
2006/0215498 A1 * 9/2006 Meier ..... 368/223

FOREIGN PATENT DOCUMENTS

CH 62172 11/1913
CH 666591 8/1988

* cited by examiner

*Primary Examiner*—Gary F. Paumen
(74) *Attorney, Agent, or Firm*—Adams & Wilks

(57) ABSTRACT

To realize an analog multifunction timepiece which is small sized and does not need much time period in operation of fabricating and integrating a part by adopting a fan shape moving hand mechanism without using a hairspring. A movement of a multifunction timepiece is provided with a calendar information display mechanism. The calendar information display mechanism is provided with a transmission wheel having a transmission cam portion, a display wheel constituted to rotate based on rotation of the transmission wheel and for displaying calendar information, a first hammer rotatably provided by being brought into contact with a transmission cam portion, and a second hammer rotatably provided in corporation with the display wheel. The first hammer includes a cam contact portion and an operating wheel portion. The second hammer is constituted to always receive a force of rotating in a constant direction.

10 Claims, 27 Drawing Sheets

| | 2 O' CLOCK (DATE HAND) | 3 O' CLOCK (DATE HAND) | 6 O' CLOCK (SMALL SECOND HAND) | 12 O' CLOCK (24 HOUR HAND) | 9 O' CLOCK (RETRO-GRADE DAY HAND) | 10 O' CLOCK (RETRO-GRADE DAY HAND) |
|---|---|---|---|---|---|---|
| FIRST KIND | — | ○ | ○ | ○ | ○ | — |
| SECOND KIND | — | ○ | ○ | — | ○ | — |
| THIRD KIND | ○ | — | ○ | — | — | ○ |

FIG. 10

MULTIFUNCTION TIMEPIECE HAVING FAN SHAPE MOVING HAND MECHANISM INCLUDING RETURN SPRING AND FAN SHAPE MOVING HAND TRAIN WHEEL APPARATUS

BACKGROUND OF THE INVENTION

1. Field of the Invention

The present invention relates to a multifunction timepiece having a fan shape moving hand mechanism including a return spring. Particularly, the invention relates to a multifunction timepiece having a fan shape moving hand mechanism which is small-sized and facilitated to fabricate and integrate a part in an analog multifunction timepiece having small hands for executing various displays. Further, the invention relates to a fan shape moving hand train wheel apparatus which is small-sized and facilitated to fabricate and integrate a part.

2. Description of the Prior Art (1) Explanation of Terminology:

Generally, a machine body including a portion of driving a timepiece is referred to as "movement". A state in which a movement is attached with a dial, hands is put into a timepiece case to constitute a finished product is referred to as "complete" 6*f* a timepiece. In both sides of a main plate constituting a base plate of a timepiece, a side having glass of a timepiece case, that is, a side having a dial of a timepiece case is referred to as "back side" or "glass side" or "dial side" of a movement. In the both sides of the main plate, a side having a case back of a timepiece case, that is, a side opposed to a dial is referred to as "top side" or "case back side" of a movement. A train wheel integrated to "top side" of a movement is referred to as "top train wheel". A train wheel integrated to "back side" of the movement is referred to as "back train wheel". Generally, "12 o'clock side" indicates a side of being arranged with a graduation in correspondence with 12 o'clock of a dial in an analog type timepiece. "12 o'clock direction" indicates a direction directed to "12 o'clock side" from a center of a main plate or a rotational center of an indicator of an hour hand or the like (hereinafter, referred to as "main, plate center"). Further, "2 o'clock side" indicates a side arranged with a graduation in correspondence with 2 o'clock of a dial in an analog type timepiece. "2 o'clock direction" indicates a direction directed to "2 o'clock side" from the main plate center.

Further, "3 o'clock side" indicates a side arranged with a graduation in correspondence with 3 o'clock of a dial. "3 o' clock direction" indicates a direction directed to "3 o'clock side" from the main plate center. Further, "6 o'clock side" indicates a side arranged with a graduation in correspondence with 6 o'clock of a dial in an analog type timepiece. "6 o'clock direction" indicates a direction directed to "6 o'clock side" from the main plate center in an analog type timepiece. Further, "9 o'clock side" indicates a side arranged with the graduation in correspondence with 9 o'clock of a dial in an analog type timepiece. "9 o'clock direction" indicates a direction directed to "9 o'clock side" from the main plate center in an analog type timepiece. Further, "10 o'clock side" indicates a side arranged with a graduation in correspondence with 10 o'clock of a dial in an analog type timepiece. "10 o'clock direction" indicates a direction directed to "10 o'clock side" from the main plate center in an analog type timepiece. Further, there is a case of indicating a side arranged with other graduation of a dial, such as "4 o'clock direction", "4 o'clock side".

Further, in the specification, there is a case in which a straight line directed to "3 o'clock side" from the main plate center is simply referred to as "3 o'clock direction". Similarly, there is a case in which a straight line directed to "12 o'clock side" from the main plate center is simply referred to as "12 o'clock direction", a straight line directed to "4 o'clock side" from the main plate center is simply referred to as "4 o'clock direction", a straight line directed to "6 o'clock side" from the main plate center is simply referred to as "6 o'clock direction", and a straight line directed to "9 o'clock side" from the main plate center is simply referred to as "9 o'clock direction". Further, in the specification, a region between "3 o'clock direction" and "4 o' clock direction" is referred to as "3-4 o'clock region". Similarly, there is a case in which a region between "12 o'clock direction" and "3 o'clock direction" is referred to as "12-3 o'clock region", a region between "3 o'clock direction" and "6 o'clock direction" is referred to as "3-6 o'clock region", a region between "3 o'clock direction" and "6 o'clock direction" is referred to as "3-6 o'clock region", a region between "6 o' clock direction" and "9 o'clock direction" is referred to as "6-9 o'clock region", and a region between "9 o'clock direction" and "12 o'clock direction" is referred to as "9-12 o'clock region".

(2) Multifunction Timepiece Having Small Hand of Background Art (2.1) Multifunction Timepiece of First Type:

In a multifunction timepiece having a small hand of a first type of a background art, a date star wheel and a small day wheel are arranged at positions substantially symmetric with each other relative to a timepiece center. A small date hand which is a kind of a small hand is attached to the date star wheel. Further, the small day hand which is a kind of a small hand is attached to the small day wheel (refer to, for example, JP-UM-A-63-187089).

(2.2) Multifunction Timepiece of Second Type:

According to a multifunction timepiece having a small hand of a second type of a background art, a date star wheel and a small day wheel are arranged at positions substantially symmetric with each other relative to a timepiece center, and a date indicator driving wheel and a day indicator driving wheel include both of a date feeding claw and a day feeding claw, respectively (refer to, for example, JP-UM-A-63-187090).

(2.3) Multifunction Timepiece of Third Type:

According to a multifunction timepiece of a third type of a background art, a main plate is provided with a train wheel rotational center of a rotor and a train wheel used for fabricating "center chronograph timepiece" and a train wheel rotational center of a rotor and a train wheel used in fabricating "side chronograph timepiece", a bridge member is provided with a train wheel rotational center of a rotor and a train wheel used in fabricating "center chronograph timepiece" and a train wheel rotational center of a rotor and a train wheel used in fabricating "side chronograph timepiece", and the rotor and the train wheel used in fabricating "side chronograph timepiece" having a chronograph hand which is a kind of a small hand are rotatably integrated to the train wheel rotational center of the main plate and the train wheel rotational center of the bridge member (refer to, for example, JP-A-2004-20421).

(2.4) Multifunction Timepiece of Fourth Type

According to a multifunction timepiece having a small hand of a fourth type of a background art, a small hand rotated by 360 degrees is arranged to "12 o'clock side", small hands moved in a fan shape are respectively arranged to "3 o'clock side" and "9 o'clock side", and a circular disk displaying moon phase is arranged to "6 o'clock side". The small hand moved in a fan shape is attached to a display wheel provided with a hairspring (refer to, for example, Switzerland Patent No. CH666591G A3).

However, the hairspring is used in the multifunction timepiece having the small hand moved in the fan shape of the background art and therefore, there poses a problem that in fabricating the timepiece, much time period is needed in operation of working and integrating parts. Further, the multifunction timepiece having the small hand moved in the fan shape of the background art cannot realize a plurality of movement layouts of a movement arranged with the small hand in 9 o'clock direction or a movement arranged with the small hand in 10 o'clock direction.

SUMMARY OF THE INVENTION

It is an object of the invention to realize an analog multifunction timepiece which is small-sized and does not need much time period in operation of fabricating and integrating parts by adopting a fan shape moving hand mechanism which does not use a hairspring.

Further, it is other object of the invention to realize an analog multifunction timepiece having a fan shape moving hand mechanism which is small-sized, does not require much space and is firmly operated.

Further, it is other object of the invention to realize a fan shape moving hand train wheel apparatus capable of displaying information to be easy to see by a small hand moved in a fan shape and constituted to be small-sized and such that much time period is not needed in operation of fabricating and integrating parts.

The invention is a multifunction timepiece including a main plate constituting a base plate of a movement, a hand setting stem for correcting display, a switching mechanism for switching a position of the hand setting stem, a dial for displaying time information, and a small hand for displaying time information or calendar information, the multifunction timepiece comprises a calendar information display mechanism constituted to be able to display the calendar information by the small hand moved in a fan shape, the calendar information display mechanism comprises a transmission wheel constituted to rotate based on rotation of an hour wheel and having a transmission cam portion, a display wheel constituted to rotate based on rotation of the transmission wheel and for displaying the calendar information.

The multifunction timepiece further includes a first hammer rotatably provided by being brought into contact with the transmission cam portion and a second hammer rotatably provided in corporation with the display wheel. The first hammer includes a cam contact portion and an operating wheel portion. The second hammer is characterized in being constituted to always receive a force of rotating in a constant direction. The constitution does not use a hairspring and therefore, much time period is not needed in operation of fabricating and integrating parts.

Further, it is preferable that in the multifunction timepiece of the invention, the first hammer includes the cam contact portion and the operating wheel portion, and the cam contact portion of the first hammer is constituted to be brought into contact with a transmission cam outer peripheral portion of the transmission cam portion and the operating wheel portion of the first hammer is constituted to be brought in mesh with a wheel portion of the display wheel. It is preferable that a hammer wheel portion of the second hammer is constituted to be brought in mesh with the wheel portion of the display wheel. By the constitution, a small-sized analog multifunction timepiece having a fan shape moving hand mechanism operated firmly can be provided.

Further, in the multifunction timepiece of the invention, it is preferable that the force of always rotating the second hammer in the constant direction is exerted by a spring force of a second hammer return spring fixed to the second hammer. By the constitution, a small-sized analog multifunction timepiece having a fan shape moving hand mechanism operated firmly can be provided.

Further, in the multifunction timepiece of the invention, the operating wheel portion of the first hammer can be constituted as a wheel with chipped teeth having an opening angle of 30 degrees through 80 degrees by constituting a reference by a rotational center of the first hammer. By the constitution, the fan shape hand moving mechanism which is firmly operated and small sized can be fabricated.

Further, in the multifunction timepiece of the invention, a hammer wheel portion of the second hammer can be constituted as a wheel with chipped teeth having an opening angle of 30 degrees through 80 degrees by constituting a reference by a rotational center of the second hammer. By the constitution, an analog multifunction timepiece which is small-sized and facilitated to fabricate and integrate can be provided.

Further, the invention is a fan shape moving hand train wheel apparatus constituted to be able to display information by a small hand moved in a fan shape, the fan shape moving hand train wheel apparatus including a transmission wheel having a transmission cam portion, a display wheel constituted to rotate based on rotation of the transmission wheel and for displaying the information, a first hammer rotatably provided by being brought into contact with the transmission cam portion, and a second hammer rotatably provided in corporation with a display wheel. According to the fan shape moving hand train wheel apparatus, the first hammer includes a cam contact portion and an operating wheel portion, and the second hammer is characterized in being constituted to always receive a force of rotating in a constant direction. By the constitution, a fan shape moving hand train wheel apparatus which is small-sized and facilitated to fabricate can be provided.

BRIEF DESCRIPTION OF THE SEVERAL VIEWS OF THE DRAWINGS

A preferred form of the present invention is illustrated in the accompanying drawings in which:

FIG. 10 is a diagram showing a table of a hand position and a hand specification of a small hand according to the first embodiment of the multifunction timepiece of the invention;

DETAILED DESCRIPTION OF THE PREFERRED EMBODIMENTS

Embodiments of the invention will be explained as follows in reference to the drawings.

(1) First Embodiment

First, a first embodiment related to a multifunction timepiece of the invention will be explained.

(1.1) Structure of Total of Movement:

In reference to FIG. 1 through FIG. 6, according to the first embodiment, a movement is constituted by an analog electronic timepiece. Further in details, the first embodiment of the multifunction timepiece of the invention is constituted by an analog type timepiece (electric timepiece, electronic timepiece, mechanical timepiece) having a small hand capable of being moved to rotated at at least one portion in "3 o'clock direction", "6 o'clock direction", "12 o' clock direction" and having a small hand capable of being moved in a fan shape in "9 o'clock direction". That is, the first embodiment of the multifunction timepiece of the invention can be constituted to display time information with regard to "hour" of a 12 hours system, display time information with regard to "minute" by a minute hand in a rotational center of which is disposed at a center of a main plate, display time information with regard to "hour" of a 24 hour system by a 24 hour hand arranged in "12 o'clock direction", display calendar information with regard to "date" by a date hand a rotational center of which is arranged in "3 o'clock direction", display time information with regard to "second" by a small second hand a rotational) center of which is arranged in "6 o'clock direction", display calendar information with regard to "day" by a so-to-speak "retrograde type" by a day hand a rotational center of which is arranged in "9 o'clock direction" and which can be moved in a fan shape.

According to the first embodiment, a movement 201C includes a main plate 202. A power source portion, a circuit portion, a converter (step motor), a top train wheel, a switching mechanism and the like are arranged on a case back side (top side) of the main plate 202. A back train wheel, a calendar train wheel, a date correction mechanism and the like are arranged on a back side of the main plate 202. A dial 454 is arranged on a glass side of the main plate 202. A hand setting stem 210 is rotatably arranged on 3 o'clock side of the main plate 202.

Figure 1:
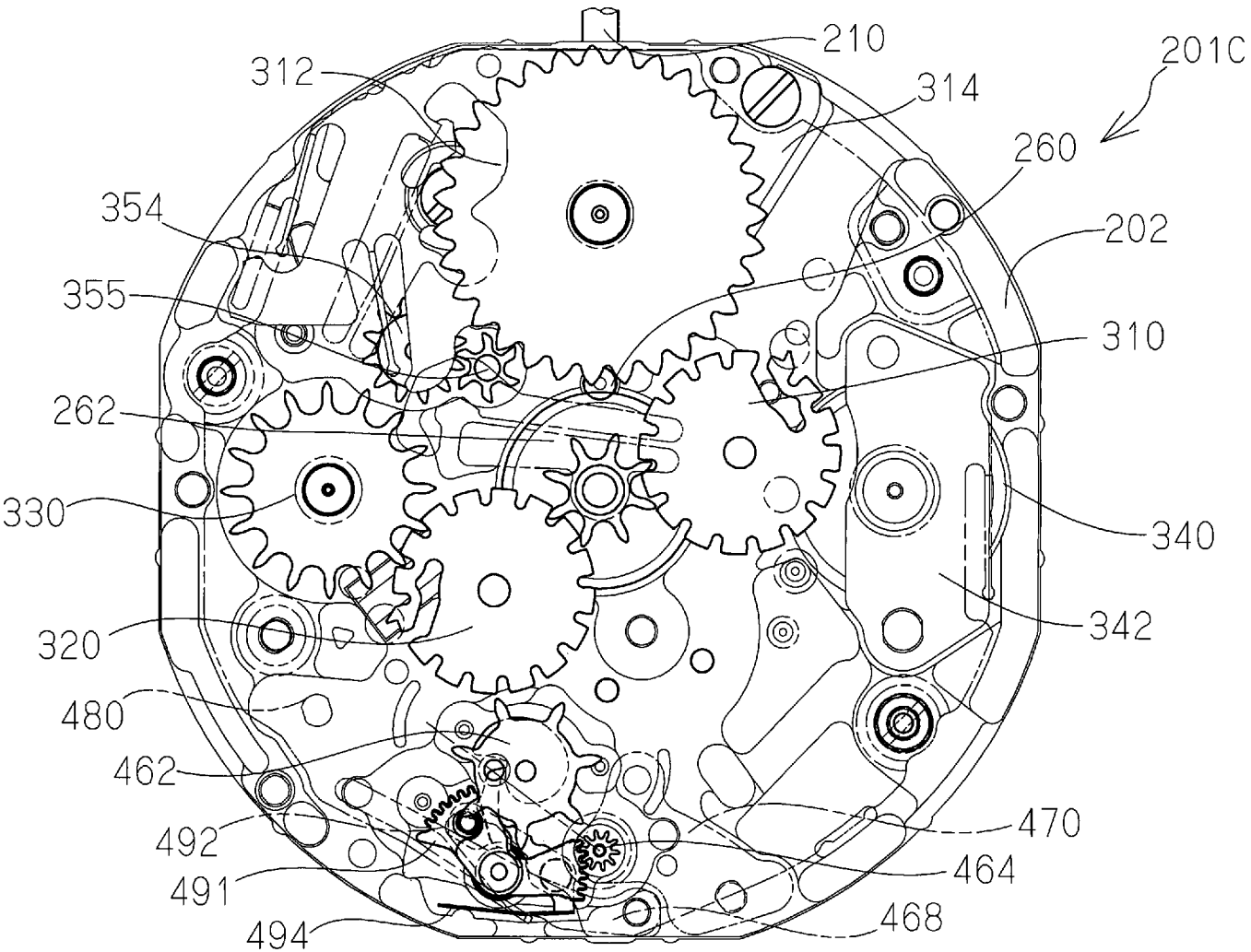
FIG. 1 is a plane view showing an outline structure viewed from a back side of a movement according to a first embodiment of a multifunction timepiece of the invention.
Figure 2:
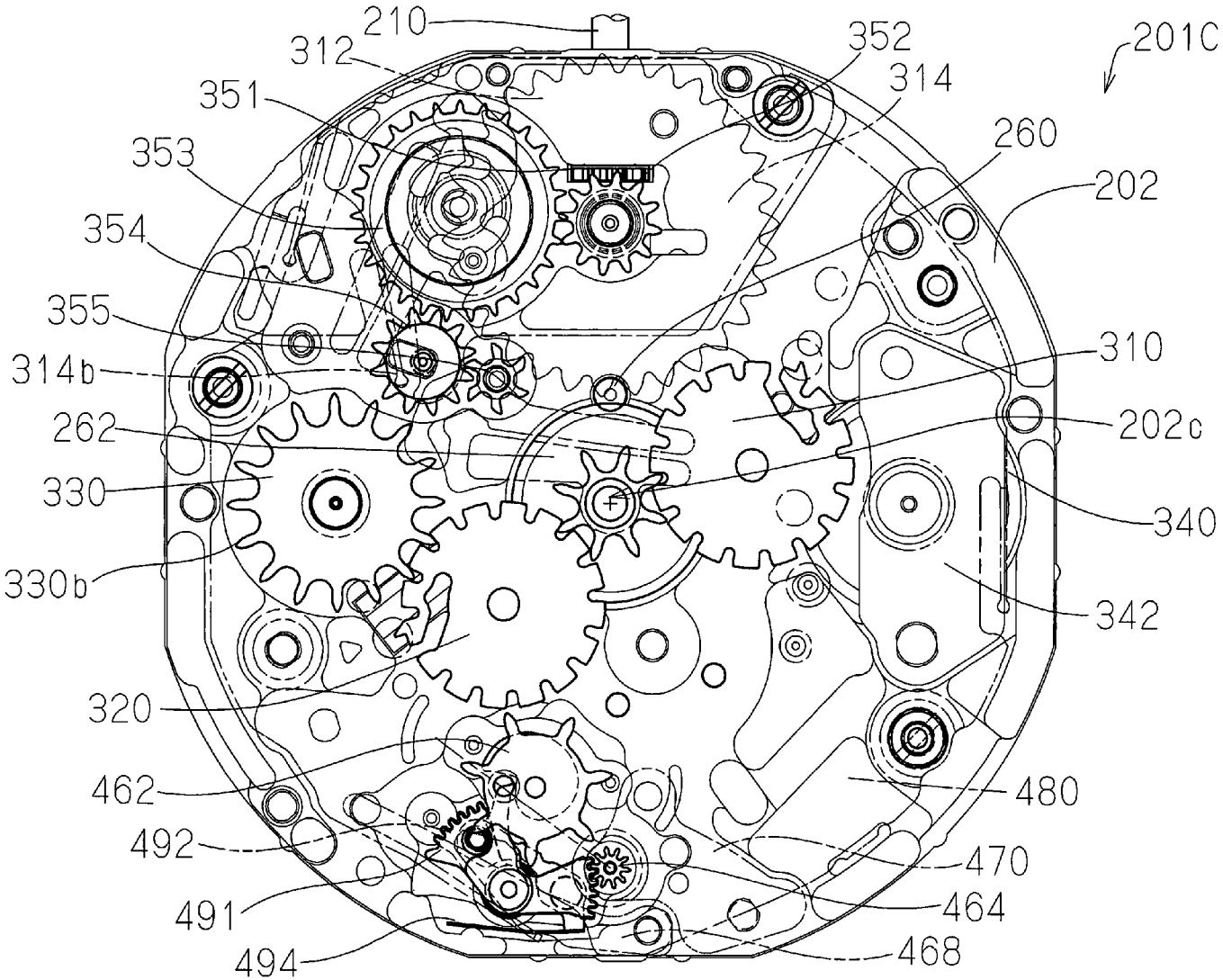
FIG. 2 is a plane view showing a date correcting mechanism on the back side of the movement according to the first embodiment of the multifunction timepiece of the invention.
Figure 3:
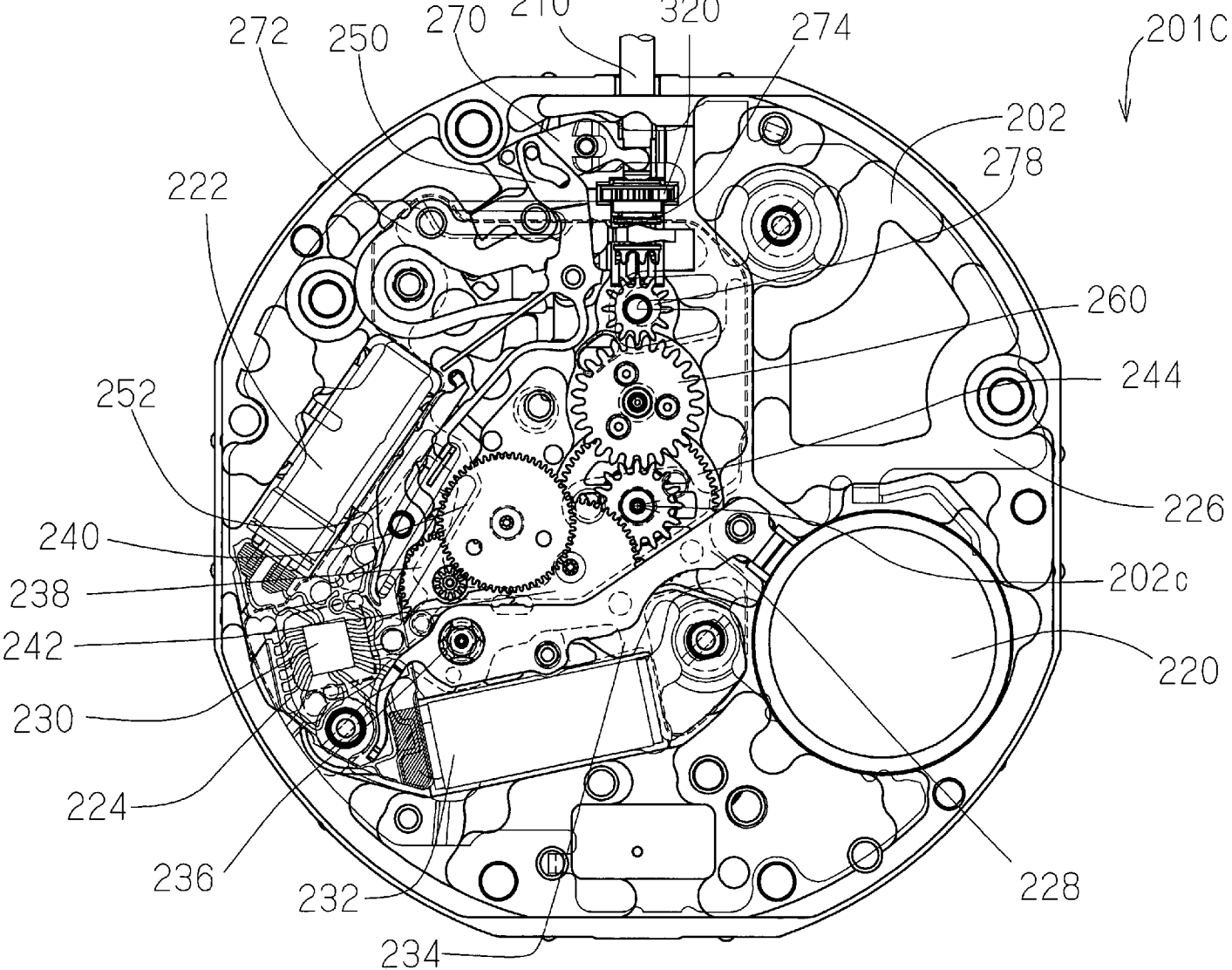
FIG. 3 is a plane view showing an outline structure viewed from a top side of the movement according to the first embodiment of the multifunction timepiece of the invention.

(1.2) Structure of Power Source Portion, Circuit Portion:

In reference to FIG. 3, a battery 220 constituting a power source of the multifunction timepiece is arranged on the case back side of the main plate 202. A quartz unit 222 constituting an oscillation source of the timepiece is arranged on the case backside of the main plate 202. A quarts oscillator oscillated by, for example, 32, 768 Hertz is contained in the quartz unit 222. A lead portion of the quartz unit 222 is fixed to a circuit board 224. A battery plus terminal 226 is arranged to conduct an anode of the battery 220 and a plus pattern of the circuit board 224. A battery minus terminal 228 is arranged to conduct the anode of the battery 220 and a minus pattern of the circuit board 224. The multifunction timepiece of the invention can be constituted by a timepiece having a reference signal generating source (oscillation source) other than the quartz unit.

An oscillating portion (oscillator) for outputting a reference signal based on oscillation of the quartz oscillator, a dividing portion (divider) for dividing an output signal of the oscillating portion, and a driving portion (driver) for outputting a motor drive signal for driving the motor based on an output signal of the dividing portion are included in an integrated circuit (IC) 230. The integrated circuit (IC) 230 is constituted by C-MOS or PLA. When the integrated circuit (IC) 230 is constituted by C-MOS, the oscillating portion, the dividing portion and the driving portion are included in the integrated circuit 230. When the integrated circuit (IC) 230 is constituted by PLA, the oscillating portion, the dividing portion and the driving portion are constituted to be operated by programs stored to PLA. The integrated circuit 230 is fixed to the circuit board 224. The circuit board 224, the quartz unit 222 and the integrated circuit 230 constitute a circuit block.

Figure 4:
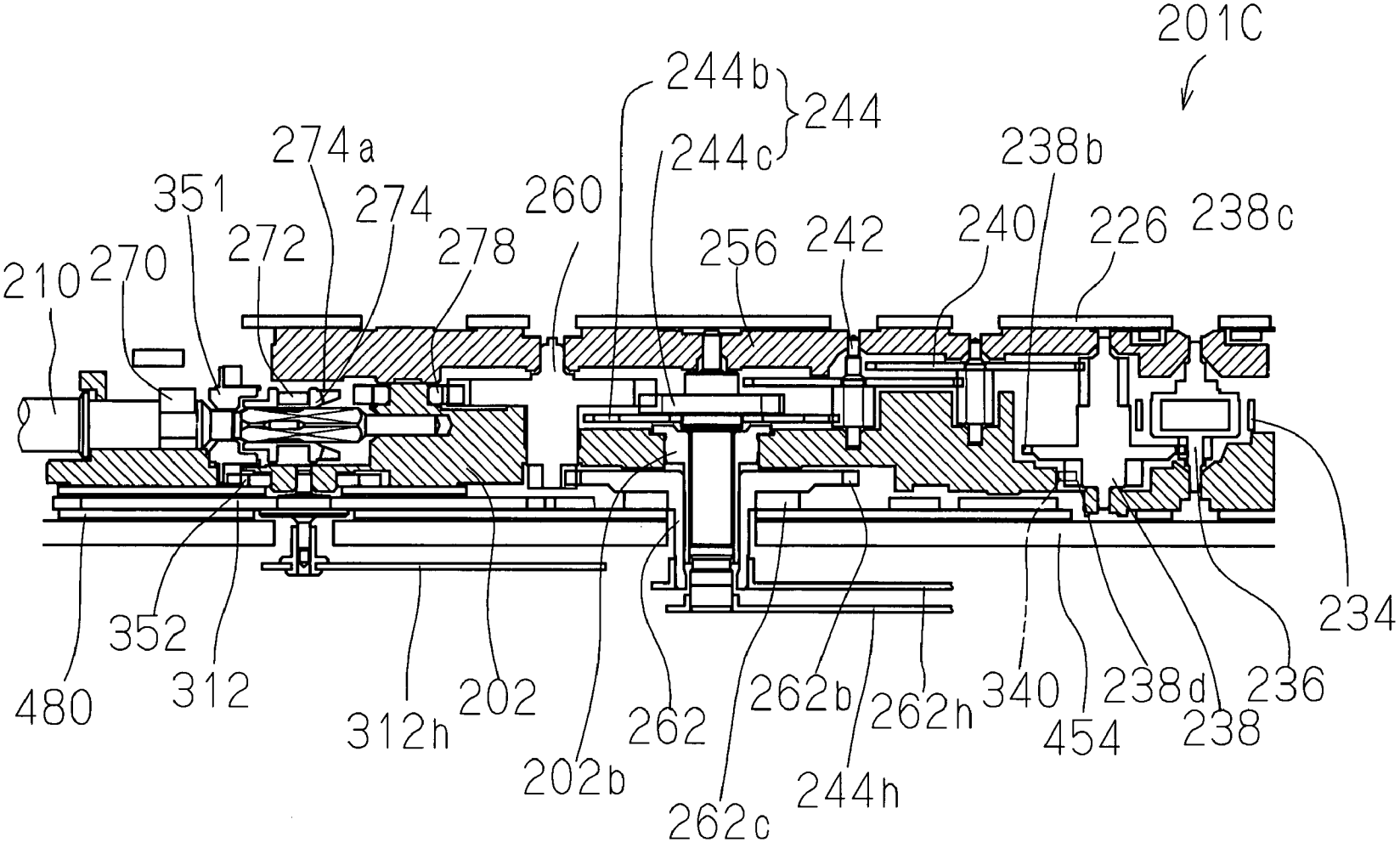
FIG. 4 is a partial sectional view showing portions of a hand setting stem and a top train wheel according to the first embodiment of the multifunction timepiece of the invention.
Figure 5:
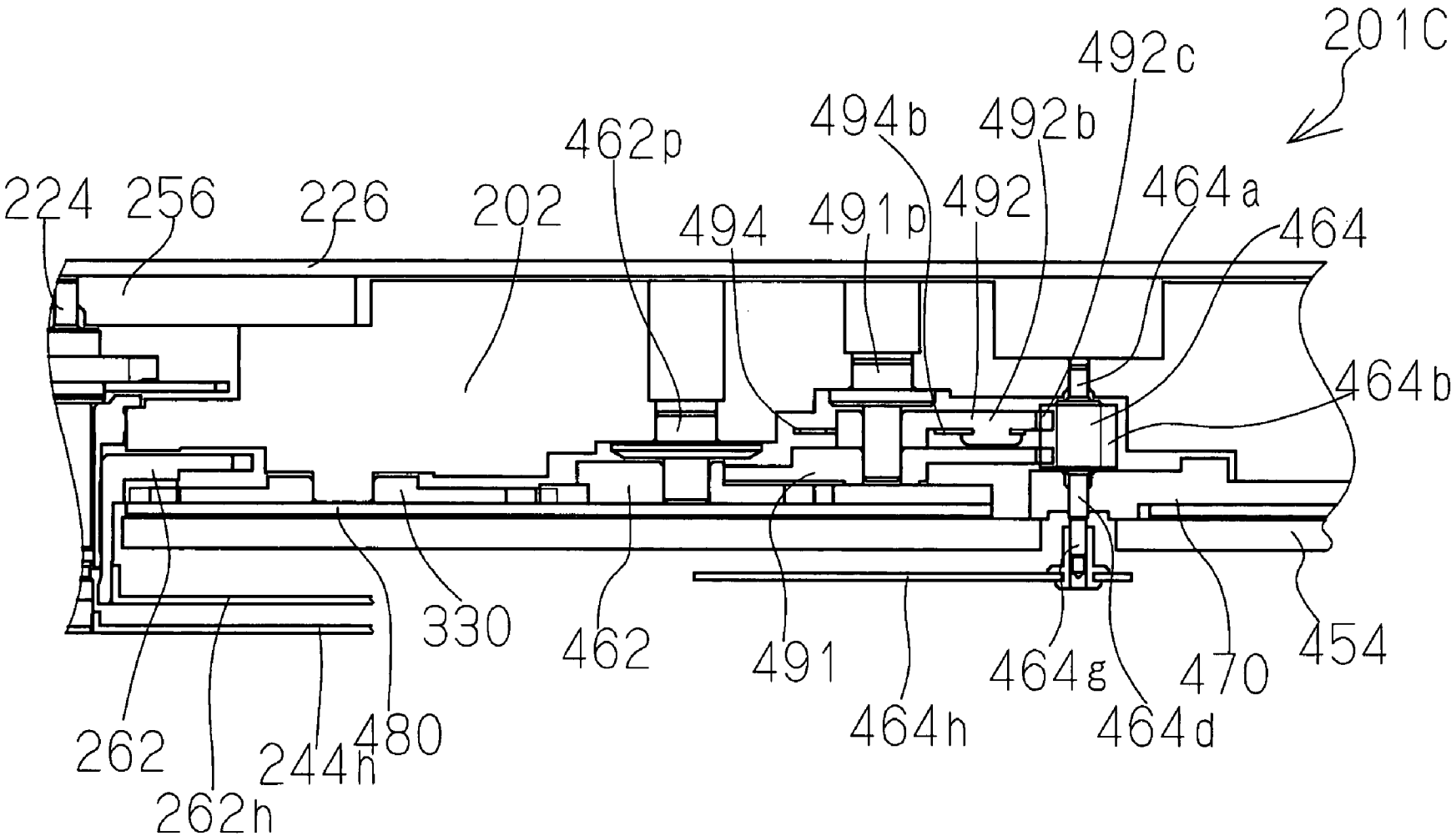
FIG. 5 is a partial sectional view showing a portion of a day feeding mechanism according to the first embodiment of the multifunction timepiece of the invention.

(1.3) Structure of Step Motor:

In reference to FIG. 3 and FIG. 4, a coil block 232 including a coil wire wound around a magnetic core, a stator 234 arranged to be brought into contact with both end portions of the magnetic core of the coil block 232, and a rotor 236 including a rotor magnet arranged at a rotor hole of the stator 234 are arranged on the case back side of the main plate 202. The coil block 232, the stator 234 and the rotor 236 constitute a step motor.

(1.4) Structure of Top Train Wheel:

A fifth wheel & pinion 238 rotated based on rotation of the rotor 236 is arranged on the case back side of the main plate 202. The fifth wheel & pinion 238 includes a fifth wheel 238*b*, a fifth upper pinion 238*c*, a fifth lower pinion 238*d*. A rotor pinion is constituted to be brought in mesh with the fifth wheel 238*b*. A fourth wheel & pinion 240 rotated based on rotation of the fifth wheel & pinion 238 is arranged on the case back side of the main plate 202. The fifth pinion is constituted to be brought in mesh with the fourth wheel. A third wheel & pinion 242 rotated based on rotation of the fourth wheel & pinion 240 is arranged on the case back side of the main plate 202. The fourth pinion is constituted to be brought in mesh with the third wheel. A center wheel & pinion 244 rotated based on rotation of the third wheel & pinion 242 is arranged on the case back side of the main plate 202. The center wheel & pinion 244 includes a center wheel 244*b* and a center pinion 244*c*. The third pinion is constituted to be brought in mesh with the second wheel 244*b*. A slip mechanism is provided between the center wheel 244*b* and the center pinion 244*c*. By providing the slip mechanism, when hands are set, in a state of stopping to rotate the top train wheel, by rotating the hand setting stem 210, a minute hand and an hour hand can be rotated. A minute hand 244*h* is attached to the center wheel & pinion 244.

When the hand setting stem 210 is pulled out to a second stage to set hands, in order to stop the fourth train wheel 240, a train wheel stopping lever 250 is arranged on the case back side of the main plate 202. When the hand setting stem 210 is pulled out to the second stage to set hands, in order to reset operation of the integrated circuit 230, a reset lever 252 is arranged on the case back side of the main plate 202. A train wheel bridge 256 respectively rotatably supports an upper shaft portion of the rotor 236, an upper shaft portion of the fifth wheel & pinion 238, an upper shaft portion of the fourth wheel & pinion 240, an upper shaft portion of the third wheel & pinion 242 and an upper shaft portion of the center wheel & pinion 244. The main plate 202 respectively rotatably supports a lower shaft portion of the rotor 236, a lower shaft portion of the fifth wheel & pinion 238, a lower shaft portion of the fourth wheel & pinion 240, and a lower shaft portion of the third wheel & pinion 242. A center pipe 202*b* is arranged at a main plate center 202*c* of the main plate 202. An abacus bead portion of the center wheel & pinion 244 is rotatably supported by an inner diameter portion of a center hole of the center pipe 202*b*. A rotational center of the center wheel & pinion 244 is arranged at the main plate center 202*c*.

The center wheel & pinion 244 is constituted to rotate by one rotation per hour. A minute wheel 260 rotated based on rotation of the center wheel & pinion 244 is arranged on the case back side of the main plate 202. The center pinion 244*c* is constituted to be brought in mesh with the minute wheel. An hour wheel 262 is constituted to rotate based on rotation of the minute wheel 260. The hour wheel 262 is arranged on a dial side of the main plate 202. The hour wheel 262 includes an hour wheel 262*b* and a date indicator driving pinion 262*c*. A center hole of the hour wheel 262 is arranged to be rotatable relative to an outer peripheral portion of a cylinder portion of the center pipe 202*b*. A minute pinion is constituted to be brought in mesh with the hour wheel 262*b* of the hour wheel 262. The hour wheel 262 is constituted to rotate by one rotation per 12 hours. An hour hand 262*h* is attached to the hour wheel 262. A rotational center of the hour wheel 262 is arranged at the main plate center 202*c*. It is constituted that time information with regard to "hour" can be displayed by the hour hand 262*h* in a style of constituting 12 hours by one turn (referred to as "12 hour system"), and time information with regard to "minute" can be displayed by the minute hand 244*h*. As a modified example, by using a publicly-known middle 3 hands train wheel mechanism, a second wheel (not illustrated) for middle 3 hands having a rotational center at the main plate center 202*c* can also be provided. In the case of the modified example using the middle 3 hands train wheel mechanism, the second hand for middle 3 hands is constituted to rotate once per minute. Time information with regard to "second" can be displayed by the second hand (not illustrated) attached to the second wheel for middle 3 hands.

(1.5) Structure of Switching Mechanism:

Next, a structure of a switching mechanism will be explained. According to the first embodiment, the switching mechanism is arranged on the case back side of the main plate 202. The switching mechanism is arranged at "3-6 o'clock region". As a modified example, the switching mechanism can also be arranged on the dial side of the main plate 202. The switching mechanism, a time setting mechanism and a calendar correcting mechanism are provided for setting time of the timepiece and correcting calendar display by rotating the hand setting stem 210 in a state of pulling out the hand setting stem 210. In reference to FIG. 3, FIG. 4 and FIG. 6, the switching mechanism is constituted to include a setting lever 270, and a yoke 272. The setting lever 270 and the yoke 272 are operably supported by the main plate 202. According to the constitution, the yoke 272 is constituted to include a yoke spring portion at one tail portion. By bringing the setting lever 270 and the yoke 272 into contact with each other, a position in a rotating direction of the setting lever can be determined.

The time setting mechanism includes the hand setting stem 210 and a clutch wheel 274. The hand setting stem 210 includes a front end shaft portion, a square shaft portion, a first date indicator setting transmission wheel guiding portion, a setting lever inner wall portion, a setting lever receiving portion, a setting lever outer wall portion, and an outer side shaft portion and the like formed in this order from a front end portion to an outer portion. The front end shaft portion of the hand setting stem 210 is rotatably supported by a hand setting stem front end guide hole of the main plate 202. An outer side portion of the setting lever outer wall portion of the hand setting stem 210 is rotatably supported by a hand setting stem outer side shaft guide hole of the main plate 202. Or, the switching mechanism may be constituted to include the setting lever, the yoke and a yoke holder (not illustrated). According to the constitution, the position in the rotational direction of the setting lever can be determined by providing a switching spring portion at the yoke holder, providing a switch pin portion at the setting lever, providing a hat shape portion at a front end of the switching spring portion, and bringing the hat shape portion having an elastic force into contact with the switch pin portion.

The square hole portion of the clutch wheel 274 is integrated to the square shaft portion of the hand setting stem 210. A portion of the setting lever 270 in contact with the hand setting stem is disposed between the setting lever inner wall portion and the hand setting lever outer wall portion of the hand setting stem 210. A position of the hand setting stem 210 in a direction along a center axis line of the hand setting stem 210 is determined by the setting lever 270 and the yoke 272. A position of the clutch wheel 274 in a direction along the center axis line of the hand setting stem 210 is determined by the yoke 272. The clutch wheel 274 includes A tooth 274*a* disposed on a side proximate to a center portion of the movement 201. A center hole portion of the first date corrector setting transmission wheel 351 is rotatably integrated by the first date corrector setting transmission wheel guiding portion. The first date corrector setting transmission wheel 351 is constituted to be able to be brought in mesh with a second date corrector setting transmission wheel 352. The setting wheel 278 is arranged on the case back side of the main plate 202. The setting wheel 278 is rotatably supported by a setting wheel pin of the main plate 202. The minute wheel 260 is constituted to rotate by rotating the setting wheel 278.

When the hand setting stem 210 is disposed at 0 stage, it is constituted that even when the hand setting stem 210 is rotated, the first date corrector setting transmission wheel 320 cannot be rotated and also the setting wheel 278 cannot be rotated. In a state of pulling out the hand setting stem 210 to 1 stage, the center hole portion of the first date corrector setting transmission wheel 351 is constituted to be fitted to the square shaft portion of the hand setting stem 210. By rotating the hand setting stem 210 in the state of pulling out the hand setting stem 210 to 1 stage, the first date corrector setting transmission wheel 351 is constituted to be able to rotate. In a state of pulling out the hand setting stem 210 to 2 stage, A tooth 274*a* of the clutch wheel 274 is constituted to be able to be brought in mesh with the setting wheel 278. In the state of pulling out the hand setting stem 210 to 2 stage, by rotating the hand setting stem 210, the setting wheel 278 is constituted to be able to rotate via rotation of the clutch wheel 274. By rotating the setting wheel 278, the center pinion of the center wheel & pinion 244 and the hour wheel 262 are constituted to rotate via rotation of the minute wheel 260. When hands are set in the state of pulling out the hand setting stem 210 to 2 stage, the center pinion of the center wheel & pinion 244 is constituted to be able to slip relative to the center wheel of the center wheel of the center wheel & pinion 244.

(1.6) Structure of Date Display Mechanism:

Next, a structure of a date display mechanism will be explained. In reference to FIG. 1, FIG. 2, FIG. 4 and FIG. 6, a date indicator feeding mechanism is constituted to operate based on rotation of the hour wheel 262. The date display mechanism includes a date indicator driving wheel 310 and a date star wheel 312. The date indicator driving wheel 310 is constituted to rotate by rotation of the hour wheel 262. The date indicator driving wheel 310 is rotatably supported by a date indicator driving wheel pin provided at the main plate 202. It is preferable to arrange a rotational center of the date indicator driving wheel 310 at a region between "5 o' clock direction" and "6 o'clock direction" (that is, "5-6 o'clock region").

The date indictor driving wheel 310 includes a date indicator driving teeth 310*b* and a date indicator driving claw 310*f*. A date indicator driving pinion 262*c* of the hour wheel 262 is constituted to be brought in mesh with the date indicator driving teeth 310*b* of the date indicator driving wheel 310. The date star wheel 312 is constituted to be rotated once per day (1/31) by the date indicator feeding claw 310*f* provided at the date indicator driving wheel 310. The date star wheel 312 is constituted to rotate one rotation per 31 days. A wheel portion of the date star wheel 312 includes 31 pieces of teeth. A position in the rotational direction of the date star wheel 312 is stopped by a date jumper 316*b* installed at a back object holder 316. It is preferable to arrange a stopping portion provided at a front end of a spring portion of the date jumper 316*b* at a region between "2 o'clock direction" and "3 o'clock direction" (that is, "2-3 o'clock region").

A rotational center of the date star wheel 312 is arranged in "3 o'clock direction". Therefore, a rotational center of the date star wheel 312 is arranged on the center axis line of the hand setting stem 210. A lower shaft portion of the date star wheel 312 is rotatably supported by the main plate 202. A portion of the date corrector transmission wheel holder 314 disposed on the lower side of the date star wheel 312 is narrowed in a circular shape to the back face of the main plate 202. It is preferable to fit a hole provided at a center of the circular narrow portion of the date corrector transmission wheel holder 314 to a date corrector transmission wheel holder guide shaft portion provided at a surrounding of the date star wheel guide hole. A date hand 312*h* is attached to an upper shaft portion of the date star wheel 312. The wheel portion of the date star wheel 312 is arranged between the date corrector transmission wheel holder 314 disposed on the dial side of the main plate 202 and the back object holder 316. A character, a numeral, an abbreviated character or the like for displaying date is provided at the dial 454. By the date hand 312*h*, the character, the numeral, the abbreviated character or the like, information with regard to "date" constituting one of calendar information is constituted to be able to display.

(1.7) Structure of Day Display Mechanism:

Next, a structure of a day display mechanism will be explained. In reference to FIG. 1, FIG. 5 and FIG. 19, a day indicator feeding mechanism is constituted to operate based on rotation of the hour wheel 262. The day display mechanism includes the day indicator driving wheel 320, a day transmission wheel 462, a small day wheel 464, a day jumper 468, a first hammer 491, a second hammer 492 and a second hammer return spring 494. The day indicator driving wheel 320 is constituted to rotate by rotation of the hour wheel 362. The day indicator driving wheel 320 is rotatably supported by a day indicator driving wheel pin 320*p* provided at the main plate 202. It is preferable to arrange a rotational center of the day indicator driving wheel 320 at a region between "10 o'clock direction" and "11 o'clock direction" (that is, "10-11 o'clock region") A rotational center of the small day wheel 464 is arranged in "9 o'clock direction".

The day indicator driving wheel 320 includes a day indicator driving teeth 320*b* and a day indicator feeding claw 320*f*. The date indicator driving pinion 262*c* of the hour wheel 262 is constituted to be brought in mesh with the day indicator driving teeth 320*b* of the date indicator driving wheel 320. The date indicator transmission wheel 462 is rotatably supported by a date indicator transmission wheel pin 462*p* provided at the main plate 202. The day indicator transmission wheel 462 is provided with a day indicator transmission wheel portion and a transmission cam portion 462*c*. The transmission cam portion 462*c* includes a transmission cam outer shape portion formed to gradually increase a distance from a center axis line of the day indicator transmission wheel 462 (that is, cam radius). The radius of the cam outer shape portion is formed to smoothly increase from a minimum value RMIN to a maximum value RMAX along a circumferential direction at an outer peripheral portion of the transmission cam. A stepped difference portion at which the radius of the transmission cam outer peripheral portion is rapidly changed is arranged between a portion of the transmission cam outer peripheral portion at which the radius is constituted by the maximum value RMAX and a portion at which the radius is constituted by the minimum value RMIN. That is, the transmission cam outer peripheral portion includes a contour shape widened uniformly in a spiral shape from the minimum radius portion proximate to the rotational center of the transmission cam outer shape portion the most to the maximum radius portion of the transmission cam outer shape portion and the portion of the transmission cam outer peripheral portion constituted by the maximum value RMAX is continuous to the portion constituted by the minimum value RMIN. That is, a shape of the transmission cam outer peripheral portion can be constituted by "spiral line of ($R=r+a\theta$) of Archimedes". By constituting the transmission cam outer peripheral portion in this way, a member brought into contact with the transmission cam outer peripheral portion can smoothly be operated.

The day transmission wheel portion 462*b* is arranged on a side more proximate to the dial 454 than the transmission cam portion 462*c*. The day transmission wheel portion 462*b* of the day transmission wheel 462 includes 7 pieces of teeth. The day transmission wheel 462 is constituted to be rotated by once per day, (1/7) by rotating the day transmission wheel portion 462*b* of the day transmission wheel 462 by the day feeding claw 320*f* provided at the day indicator driving wheel 320. Therefore, the day transmission wheel 462 is constituted to rotate by one rotation per 7 days. It is preferable to arrange the rotational center of the day transmission wheel 462 at a region between "9 o' clock direction" and "10 o'clock direction" (that is, "9-10 o'clock region"). The small day wheel 464 includes a lower shaft portion 464*a*, a day wheel portion 464*b*, and an upper shaft portion 464*d*, and a hand attaching portion 464*g*. The lower shaft portion of the small day wheel 464 is rotatably supported by the main plate 202. The upper shaft portion 464*d* of the small day wheel 464 is rotatably supported by a small day wheel bridge 470. A day hand 464*h* is attached to the hand attaching portion 464*g* of the small day wheel 464.

A position in the rotational direction of the day transmission wheel 462 is constituted to be stopped by a day jumper 468 rotatably provided at the main plate 202. A day jumper pressing spring portion 480*c* provided at the back object holder 480 is constituted to press the stopping portion provided at the front end of the day jumper 468 to the day transmission wheel portion 462*b* of the day transmission wheel 462. It is preferable to arrange a position of the stopping portion provided at the front end of the day jumper 468 at a region between "9 clock direction" and "10 o'clock direction" (that is, "9-10 o'clock region"). It is preferable to arrange the position of the day jumper pressing spring portion 480*c* at a region between "9 o'clock direction" and "11 o'clock direction" (that is, "9-11 o'clock region").

A first hammer 491 is rotatably supported by a hammer pin 466*p* provided at the main plate 202. The second hammer 492 is rotatably supported by the hammer pin 466*p* provided at the main plate 202. The second hammer 492 is arranged on a side more proximate to the main plate 202 than the first hammer 491. It is preferable to arrange the position of the first hammer 491 at a region between "9 o'clock direction" and "10 o'clock direction" (that is, "9-10 o'clock region"). Itis preferable to arrange the position of the second hammer 492 at a region between "9 o'clock direction" and "10 o'clock direction" (that is, "9-10 o'clock region"). The first hammer 491 includes a cam contact portion 491*c* constituted to be brought into contact with the transmission cam portion 462*c*, a first operating wheel portion 491*f*, a second operating wheel portion 491*g* constituted to be brought in mesh with the day wheel portion 464*b*. The second operating wheel portion 491*g* is provided to be able to be brought in mesh with the day wheel portion 464*b* of the small day wheel 464. The second hammer 492 includes a hammer main body portion 492*b* and a hammer wheel portion 492*c*. The hammer wheel portion 492*c* is constituted to be brought in mesh with the day wheel portion 464*b*. As described above, the second hammer 492 is rotatably provided in corporation with the small day wheel 464.

The second hammer return spring 494 includes a return spring base portion 494*b* and a return spring portion 494*c*. The second hammer return spring 494 is a plate-like member formed by an elastic material of stainless steel, phosphor bronze or the like. Therefore, the return spring portion 494*c* can be constituted as a leaf spring. The return spring base portion 494*b* of the second hammer return spring 494 is fixed to the second hammer 492. A front end portion or a portion proximate to the front end portion of the return spring base portion 494*b* is constituted to be brought into contact with a positioning wall portion provided at the main plate 202. Particularly, in reference to FIG. 20, by a spring force of the return spring portion 494*c*, the second hammer 492 is constituted to always receive a force of being rotated in the clockwise direction. Therefore, the small day wheel 464 is constituted to always receive a force of being rotated in the counterclockwise direction. Therefore, the front end portion of the cam contact portion 491*c* of the first hammer 491 is constituted to always receive a force of being pressed to the transmission cam portion 462*c* of the day transmission wheel 462.

A rotational center of the small day wheel 464 is arranged in "9 o'clock direction". The wheel portion 464*b* of the small day wheel 464 is arranged between the main plate 202 and the small day wheel bridge 470. The dial 454 is provided with a day character, numeral, abbreviated character for displaying day. Particularly, in reference to FIG. 11, information with regard to "day" which is one of calendar information is constituted to be able to be displayed by the day hand 464*h* moved in a fan shape and the character, the numeral, the abbreviated character or the like of the dial 454.

(1.8) Structure of 24 Hour Display Mechanism:

Next, a structure of a 24 hour display mechanism will be explained. In reference to FIG. 1, the 24 hour display mechanism is constituted to be operated based on rotation of the day indicator driving wheel 320. The 24 hour display mechanism includes an hour indicator 330. By rotation of the hour wheel 262, the hour indicator 330 is constituted to rotate via rotation of the day indicator driving wheel 320. A lower shaft portion provided at the hour indicator 330 is rotatably supported by an hour indicator guide hole provided at the main plate 202. It is preferable to arrange a rotational center of the hour indicator 330 in "12 o'clock direction". A day driving teeth 320*b* provided at the day indicator driving wheel 320 is constituted to be brought in mesh with a teeth portion 330*b* of the hour wheel 330. The hour wheel 330 is constituted to rotate by one rotation per 24 hours.

The wheel portion of the hour indicator 330 is arranged between the main plate 202 and the back object holder 480. A 24 hour hand (not illustrated: mentioned later) is attached to an upper shaft portion of the hour indicator 330. The dial 204 is provided with a character, a numeral, an abbreviated character or the like for displaying "hour" in a style of constituting 24 hours by one turn (referred to as "24 hour system"). Information with regard to "hour" constituting time information is constituted to be able to be displayed by the 24 hour hand and the numeral or the like.

(1.9) Structure of Second Display Mechanism:

Next, a structure of a second display mechanism will be explained. In reference to FIG. 1 and FIG. 4, the second display mechanism is constituted to operate based on rotation of the fifth wheel & pinion 238. The second display mechanism includes the second indicator 340. The wheel portion of the second indicator 340 is constituted to be brought in mesh with the fifth lower pinion 238*d*. By rotation of the rotor 236, the second indicator 340 is constituted to rotate via rotation of the fifth wheel & pinion 238. A lower shaft portion of the second indicator 340 is rotatably supported by the main plate 202. An upper shaft portion of the second indicator 340 is rotatably supported by a second indicator bridge 342. It is preferable to arrange the second indicator bridge 342 such that the second indicator bridge 342 does not overlap the date indicator driving wheel 310. It is preferable to arrange a rotational center of the second indicator 340 in "6 o'clock direction". The second indicator 340 is constituted to rotate by one rotation per minute.

The wheel portion of the second indicator 340 is arranged between the main plate 202 and the second indicator bridge 342. A small second hand (not illustrated: mentioned later) is attached to a front end portion of the upper shaft portion of the second indicator 340. The dial 204 is provided with a character, a numeral, an abbreviated character or the like for displaying "second". Information with regard to "second" Constituting time information is constituted to be able to display by the small second hand and the numeral. As has been explained above, the first embodiment of the invention is provided with the date star wheel 312 the rotational center of which is arranged in "3 o'clock direction", the small day indicator 464 the rotational center of which is arranged in "9 o'clock direction", the second indicator 340 the rotational center of which is arranged in "6 o'clock direction", and the hour indicator 330 the rotational center of which is arranged in "12 o'clock direction".

(1.10) Structure of Date Correction Mechanism:

Next, a structure of a date correction mechanism will be explained. In reference to FIG. 1, FIG. 2, FIG. 4 and FIG. 6, the back side of the movement 201C is provided with a date correction mechanism for correcting display of date by the date star wheel 312. The date correction mechanism is constituted by a first corrector setting transmission wheel 351, a second corrector setting transmission wheel 352, a third corrector setting transmission wheel 353, a fourth corrector setting transmission wheel 354, and a date corrector setting wheel 355. In a state of setting the hand setting stem 210 to 1 stage, the first corrector setting transmission wheel 351 is rotatably supported by a first corrector setting transmission wheel guide portion of the hand setting stem 210. That is, the first corrector setting transmission wheel 351 and the hand setting stem 210 are arranged to be coaxial to each other. The second corrector setting transmission wheel 352 is rotatably supported by the main plate 202. The wheel portion of the second corrector setting transmission wheel 352 is arranged between the main plate 202 and a date corrector setting wheel holder 314. A rotational center of the second corrector setting transmission wheel 352 is arranged in "3 o'clock direction". Therefore, the rotational center of the second corrector setting transmission wheel 352 is arranged on a center axis line of the hand setting stem 210. It is preferable to arrange the rotational center of the second corrector transmission wheel 352 at a position the same as a rotational center of the date star wheel 312.

The third corrector setting transmission wheel 353 is rotatably supported by the main plate 202. A wheel portion of the third corrector setting transmission wheel 353 is arranged between the main plate 202 and the date corrector setting transmission wheel holder 314. It is preferable to arrange a rotational center of the third corrector setting transmission wheel 353 at a region in "2 o'clock direction", or between "2 o'clock direction" and "3 o'clock direction" (that is, "2-3 o'clock region"). A lower shaft of the fourth corrector setting transmission wheel 354 is movably and rotatably supported by a fourth corrector setting transmission wheel guide long hole provided at the main plate 202. A wheel portion of the fourth corrector setting transmission wheel 354 is arranged between the main plate 202 and the date corrector setting transmission wheel holder 314. It is preferable to arrange the fourth corrector setting transmission wheel guide long hole for guiding a lower shaft of the fourth corrector setting transmission wheel 354 at a region between "1 o'clock direction" and "2 o'clock direction" (that is, "1-2 o'clock region"). The date corrector setting transmission wheel holder 314 is provided with a corrector spring portion 314*b* for pressing the fourth corrector setting transmission wheel 354 to the main plate 202. A center hole of the second corrector setting transmission wheel 352 is rotatably supported by a second corrector setting transmission wheel guide shaft portion provided at the main plate 202. An inner side of the second corrector setting transmission wheel guide shaft portion is provided with a date star wheel guide hole for the date star wheel 312. A center axis line of the date star wheel guide hole and a center axis line of the second corrector setting transmission wheel guide shaft portion can be constituted to coincide with each other. The third corrector setting transmission wheel 353 is rotatably supported by a third corrector setting transmission wheel guide shaft portion in a ring-like shape provided at the main plate 202.

The date corrector setting wheel 355 is rotatably supported by a date corrector setting wheel pin provided at the main plate 202. A wheel portion of the date corrector setting wheel 355 is arranged between the main plate 202 and the back object holder 480. A wheel portion of the date corrector setting wheel 355 is constituted to be brought in mesh with the wheel portion of the date star wheel 312. The wheel portion of the date star wheel 312 is arranged between the date corrector setting transmission wheel holder 314 and the back object holder 480. It is preferable to arrange a rotational center of the date corrector setting wheel 355 at a region between "1 o'clock direction" and "2 o'clock direction" (that is, "1-2 o'clock region"). When the hand setting stem 210 is rotated in one direction and the fourth corrector setting transmission wheel 354 is moved in a direction of being proximate to the date corrector setting wheel 355 via rotation of the first corrector setting transmission wheel 351, the second corrector setting transmission wheel 352, the third corrector setting transmission wheel 353, the wheel portion of the fourth corrector setting transmission wheel 354 is constituted to be able to be brought in mesh with the wheel portion of the date corrector setting wheel 355. When the hand setting stem 210 is rotated in other direction and the fourth corrector setting transmission wheel 354 is moved in a direction of being remote from the date corrector setting wheel 355 via rotation of the first corrector setting transmission wheel 351, the second corrector setting transmission wheel 352, the third corrector setting transmission wheel 353, the wheel portion of the fourth corrector setting transmission wheel 354 is constituted not to be brought in mesh with the wheel portion of the date corrector setting wheel 355.

Figure 7:
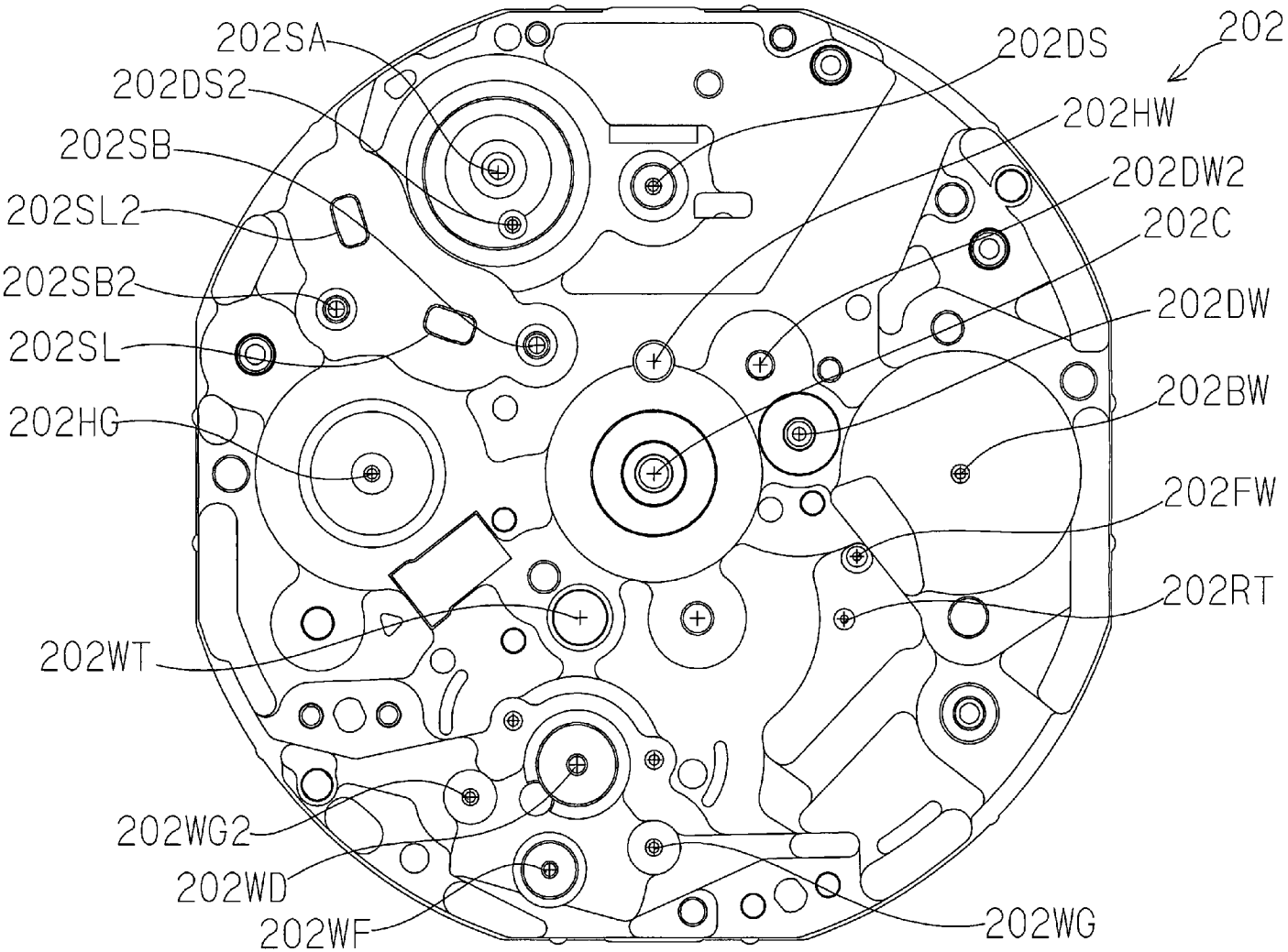
FIG. 7 is a plane view showing a shape viewed from a back side of a main plate according to the first embodiment of the multifunction timepiece of the invention.

(1.11) Structure of Main Plate:

Next, a structure of the main plate 202 will be explained. In reference to FIG. 7, according to the first embodiment, an outer shape of the main plate 202 is formed substantially in a circular shape centering on a main plate center 202*c*. Further, the outer shape of the main plate 202 may be other shape of a quadrangular shape, a polygonal shape, an oval shape or the like. The main plate 202 may be formed by an engineering plastic of polycarbonate, polysulfone or the like, or may be formed by a metal of brass or the like. The rotational center of the center wheel & pinion 244 and the rotational center of the hour wheel 262 are arranged at the main plate center 202*c*. A center axis line of the center pipe 202*b* is arranged at the main plate center 202*c*.

The main plate 202 is provided with rotational centers of rotating members of a rotational center of 202RT of the rotor 236, a rotational center 202FW of the fifth wheel & pinion 238, a rotational center (not illustrated) of the fourth wheel & pinion 240, a rotational center (not illustrated) of the third wheel & pinion 242, a rotational center 202HW of the minute wheel 260, a rotational center (not illustrated) of the setting wheel 278, a rotational center 202DW of the date indicator driving wheel 310, a rotational center 202DS of the date star wheel 312, a rotational center 202WT of the day indicator driving wheel 320, a rotational center 202HG of the hour indicator 330, a rotational center 202BW of the second indicator 340, a rotational center 202SA of the third corrector setting transmission wheel 353, a rotational center 202SB of the date corrector setting wheel 355 and the like. It is preferable to arrange a rotational center of the second corrector setting transmission wheel 352 at a position the same as the rotational center 202DS of the date star wheel 312. Further, the main plate 202 is provided with a fourth corrector setting transmission wheel guide long hole 202SL for movably guiding the lower shaft of the fourth corrector setting transmission wheel transmission wheel 354. The main plate 202 is further provided with a rotational center 202WD of the day indicator transmission wheel 462, a rotational center 202WF of the first hammer 491 and the second hammer 492, and a rotational center 202WG of the small day indicator 464. The respective rotational centers are formed with guide shaft portions for guiding center holes of rotating members to rotatably support the rotating members rotated centering on the rotational centers, or formed with guide holes for guiding the shaft portions of the rotating members. That is, a train wheel guide portion can be constituted by a guide hole, a guide bearing, a guide shaft, a guide pin or the like for rotatably guiding the rotating member.

That is, the main plate 202 is provided with the center pipe 202*b* arranged at the main plate center 202*c*, a lower bearing of the rotor 236, a lower bearing of the fifth wheel & pinion 238, a lower bearing of the fourth wheel & pinion 240, a lower bearing of the third wheel & pinion 242, a lower bearing of the minute wheel 260, a guide pin of the setting wheel 278, a guide pin of the date indicator driving wheel 310, a guide pin of the date star wheel 312, a guide pin of the day indicator driving wheel 320, a lower bearing of the small day wheel 464, a lower bearing of the hour indicator 330, a lower bearing of the second indicator 340, a guide pin of the third corrector setting transmission wheel 353, a guide pin of the date corrector setting wheel 355, a guide pin of the day indicator transmission wheel 462, and guide pins of the first hammer 491 and the second hammer 492. For example, the bearing can be constituted by a hole jewel, a mortise frame, a through hole, a blind hole or the like. For example, the guide pin can integrally be formed with the main plate 202, or a pin formed separately from the main plate 202 can be fixed to the main plate 202. Or, in place of the bearing, a guide member of a pin or the like can also be used. Or, in place of the guide pin, a guide member of a hole jewel, a mortise frame, a through hole, a blind hole or the like can also be used.

The movement 201C is provided with a first train wheel rotational center for a train wheel used in fabricating a multifunction timepiece of a first type having an arrangement of small hands of the first type, and a second train wheel rotational center for a train wheel used in fabricating a multifunction timepiece of a second type having an arrangement of small hands of the second type. The first train wheel rotational center and the second train wheel rotational center are provided with train wheel guide portions (guide holes, guide bearings, guide shafts, guide pins or the like) for rotatably guiding train wheel members rotated centering on positions thereof. The first train wheel rotational center and the second train wheel rotational center are arranged at positions between the main plate center 202*c* of the main plate 202 and a main plate outer shape portion of the main plate 202.

The respective rotational centers are formed with guide shaft portions for guiding center holes of rotating members for rotatably supporting the rotating members rotated centering on the rotational center, or formed with guide holes guiding the shaft portions of the rotating members. The guide shaft portion, the guide hole constitute a guide portion for rotatably guiding the rotating member. As described later, the main plate 202 is provided with rotational centers for rotatably supporting respective rotating members used in other embodiment.

Figure 8:
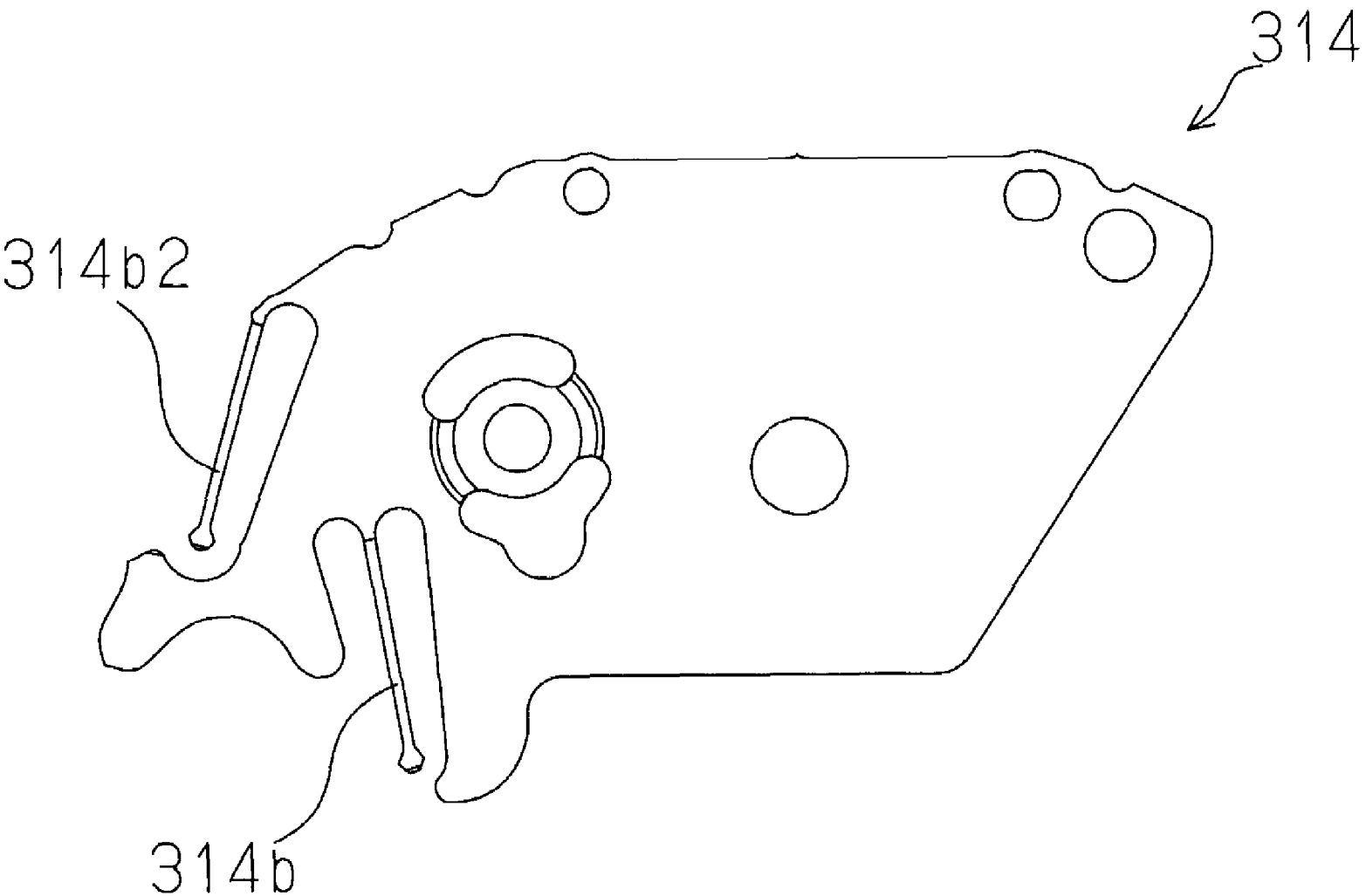
FIG. 8 is a plane view showing a shape viewed from an upper side of a date corrector setting transmission wheel holder according to the first embodiment of the multifunction timepiece of the invention.

(1.12) Structure of Date Corrector Setting Transmission Wheel Holder:

Next, a structure of the date corrector setting transmission wheel 314 will be explained. In reference to FIG. 8, the date corrector setting transmission wheel holder 314 is arranged at "12-3 o'clock region" and "3-6 o'clock region". The date corrector setting transmission wheel holder 314 is a plate-like member formed by an elastic material of stainless steel, phosphor bronze or the like. The date corrector setting transmission wheel holder 314 is provided with a corrector spring portion 314*b* for pressing the fourth corrector setting transmission wheel 354 to the main plate 202. It is preferable to arrange the corrector spring portion 314*b* at a region between "12 o'clock direction" and "3 o'clock direction" (that is, "12-3 o'clock region"). It is preferable to arrange a front end portion of the corrector spring portion 314*b* brought into contact with the fourth corrector setting transmission wheel 354 at a region between "12 o' clock direction" and "10"clock direction" (that is, "12-1 o'clock region"). Further, it is preferable to constitute such that a portion of the date corrector setting transmission wheel holder 314 disposed on a lower side of the date star wheel 312 is narrowed in a circular shape toward the back face of the main plate 202 and a hole provided at a center of the circular narrowed portion is fitted to the date corrector setting transmission wheel holder guide shaft portion provided at a surrounding of the date star wheel guide hole. The date corrector setting transmission wheel holder 314 is further provided with a corrector spring portion 314*b*2 used in other embodiment.

Figure 9:
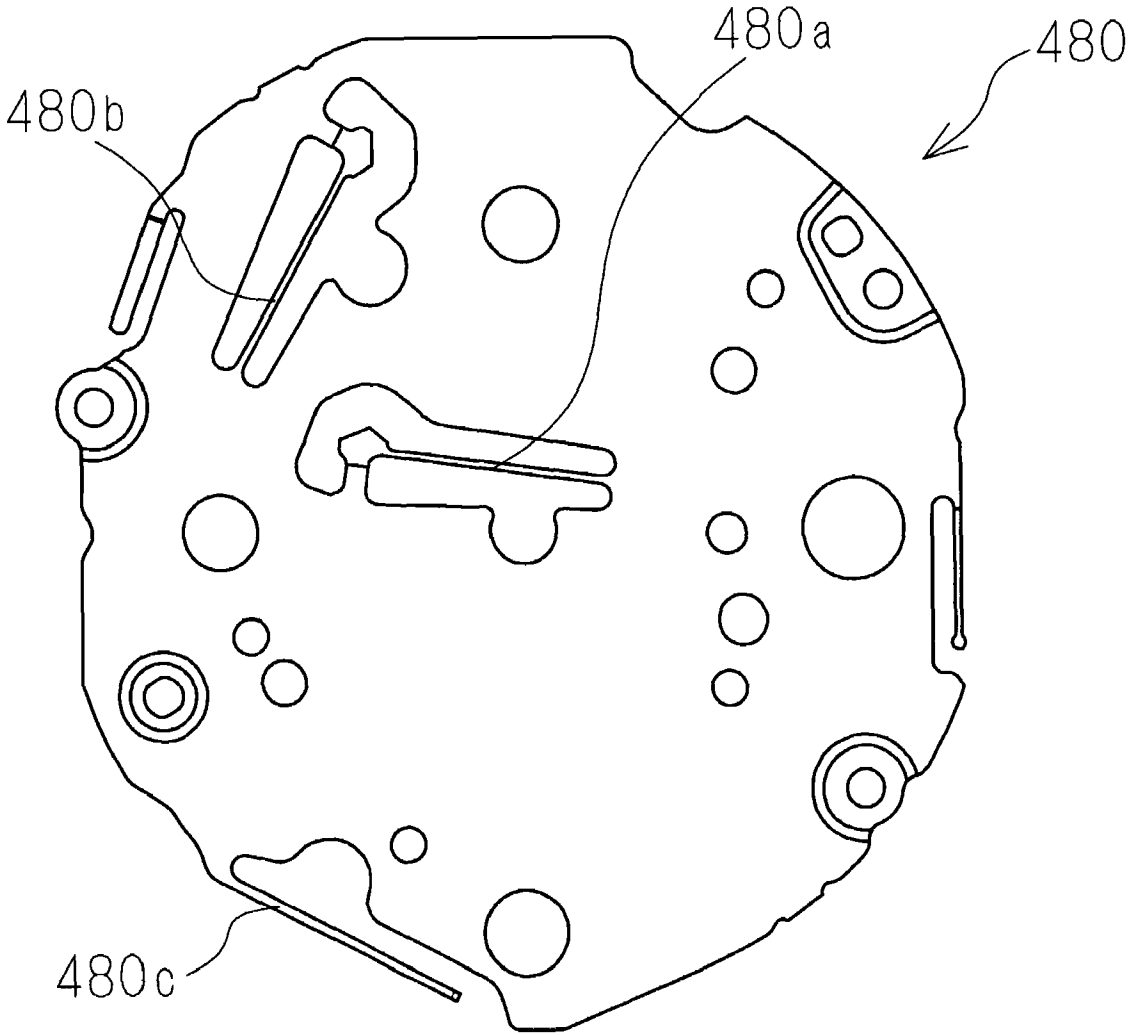
FIG. 9 is a plane view showing a shape viewed from an upper side of a back object holder according to the first embodiment of the multifunction timepiece of the invention.

(1.13) Structure of Back Object Holder:

Next, a structure of a back object holder 480 will be explained. In reference to FIG. 9, the back object holder 316 is a plate-like member formed by an elastic material of stainless steel, phosphor bronze or the like. The back object holder 480 includes a first date jumper 480*a* for stopping the position in the rotational direction of the date star wheel 312 according to the first embodiment, a second date jumper 480*b* for stopping the position in the rotational direction of the date star wheel 312 according to the second embodiment, and a day jumper pressing portion 480*c* for pressing the stopping portion provided at the front end of the day jumper 468 to a day indicator transmission wheel portion 462*b* of the day indicator transmission wheel 462.

It is preferable to arrange a spring portion of the first date jumper 480*a* at a region between "2 o'clock direction" and "6, o'clock direction" (that is, "2-6 o'clock region"). It is preferable to arrange the stopping portion provided at the front end of the spring portion of the first date jumper 480*a* at a region between "1 o'clock direction" and "3 o'clock direction" (that is, "1-3 o'clock region"). It is preferable to arrange the spring portion of the second date jumper 480*b* at a region between "11 o'clock direction" and "1 o'clock direction" (that is, "11-1 o'clock region"). It is preferable to arrange the stopping portion provided at the front end of the spring portion of the second date jumper 480*b* at a region between "12 o'clock direction" and "1 o'clock direction" (that is, "12-1 o'clock region". It is preferable to arrange the position of the day jumper pressing spring portion 480*c* at a region between "9 o'clock direction" and "11 o'clock direction" (that is, "9-11 O'clock region").

(1.14) Operation of Step Motor, Train Wheel, Date Feeding Mechanism or the Like:

Operation of the first embodiment will be explained as follows. In reference to FIG. 1, FIG. 3 and FIG. 6, in the movement 201C, the quartz oscillator contained in the quartz unit 222 is oscillated by, for example, 32,768 Hertz. Based on oscillation of the quartz oscillator, an oscillating portion included in the integrated circuit 230 outputs the reference signal and the dividing portion divides the output signal of the oscillating portion. Based on the output signal of the dividing portion, the driving portion outputs the motor driving signal for driving the step motor. When the coil block 232 inputs the motor driving signal, the stator 234 is magnetized to rotate the rotor 236. The rotor 236 is rotated by, for example, 180 degrees per second. Based on rotation of the rotor 236, the fourth wheel & pinion 240 is rotated via rotation of the fifth wheel & pinion 238. Further, based on rotation of the rotor 236, the second indicator 340 is rotated by one rotation per minute via rotation of the fifth wheel & pinion 238. The third wheel & pinion 242 is rotated based on rotation of the fourth wheel & pinion 240.

In reference to FIG. 1 through FIG. 6, based on rotation of the third wheel & pinion 242, the center wheel & pinion 244 is rotated by one rotation per hour. The minute wheel 260 is rotated based on rotation of the center wheel & pinion 244. The hour wheel 262 is rotated based on rotation of the minute wheel 260. The hour wheel 262 is rotated by one rotation per 12 hours. By rotation of the hour wheel 262, the date indicator driving wheel 310 is rotated. By the date indicator feeding claw 310*f* provided at the date indicator driving wheel 310, the date star wheel 312 is rotated by once per day, (1/31). The date star wheel 312 is constituted to rotate by one rotation per 31 days.

(1.15) Operation of Day Feeding Mechanism:

Operation of a day feeing mechanism will be explained as follows according to the first embodiment of the multifunction timepiece of the invention. In reference to FIG. 1, FIG. 5 and FIG. 19, in a state of indicating "Sun" representing "Sunday" by the day hand 464*h*, a character, a numeral, an abbreviated character or the like of the dial 454, by rotating the hour wheel 262, the day indicator driving wheel 320 is rotated. By rotating the day indicator setting transmission wheel portion 462*b* of the day indicator setting transmission wheel 462 by the day feeding claw 320*f* provided at the day indicator setting transmission wheel 320, the day indicator setting transmission wheel 462 is rotated by once per day, (1/7). The position in the rotational direction of the day indicator setting transmission wheel 462 is stopped by the day jumper 468 rotatably provided at the main plate 202. The day jumper pressing spring portion 480*c* provided at the back object pressing portion 480 presses the stopping portion provided at the front end of the day jumper 460 to the day indicator setting transmission wheel portion 462*b* of the day indicator setting transmission wheel 462.

The cam contact portion 491*c* of the first hammer 491 is brought into contact with the transmission cam portion 462*c*. The first operating wheel portion 491*f* of the first hammer 491 is brought in mesh with the date indicator wheel portion 464*b*. A hammer wheel portion 492*c* of the second hammer 492 is brought in mesh with the day indicator wheel portion 464*b*. The front end portion or the portion proximate to the front end portion of the return spring base portion 494*b* of the second hammer return spring 494 is brought into contact with the spring positioning wall portion provided at the main plate 202. By the spring force of the return spring portion 494*c*, the second hammer 492 always receives the force of rotating in the clockwise direction. Therefore, the small day wheel 464 receives always a force of rotating in the counterclockwise direction. Therefore, the front end portion of the cam contact portion 491*c* of the first hammer 491 always receives the force of being pressed to the transmission cam portion 462*c* of the day indicator transmission wheel 462. In a state of indicating "Sun" representing "Sunday" by the small day wheel 464, the front end portion of the cam contact portion 491*c* of the first hammer 491 is pressed to a portion of the transmission cam portion 462*c* of the day indicator transmission wheel 462 proximate to the minimum radius portion.

Figure 19:
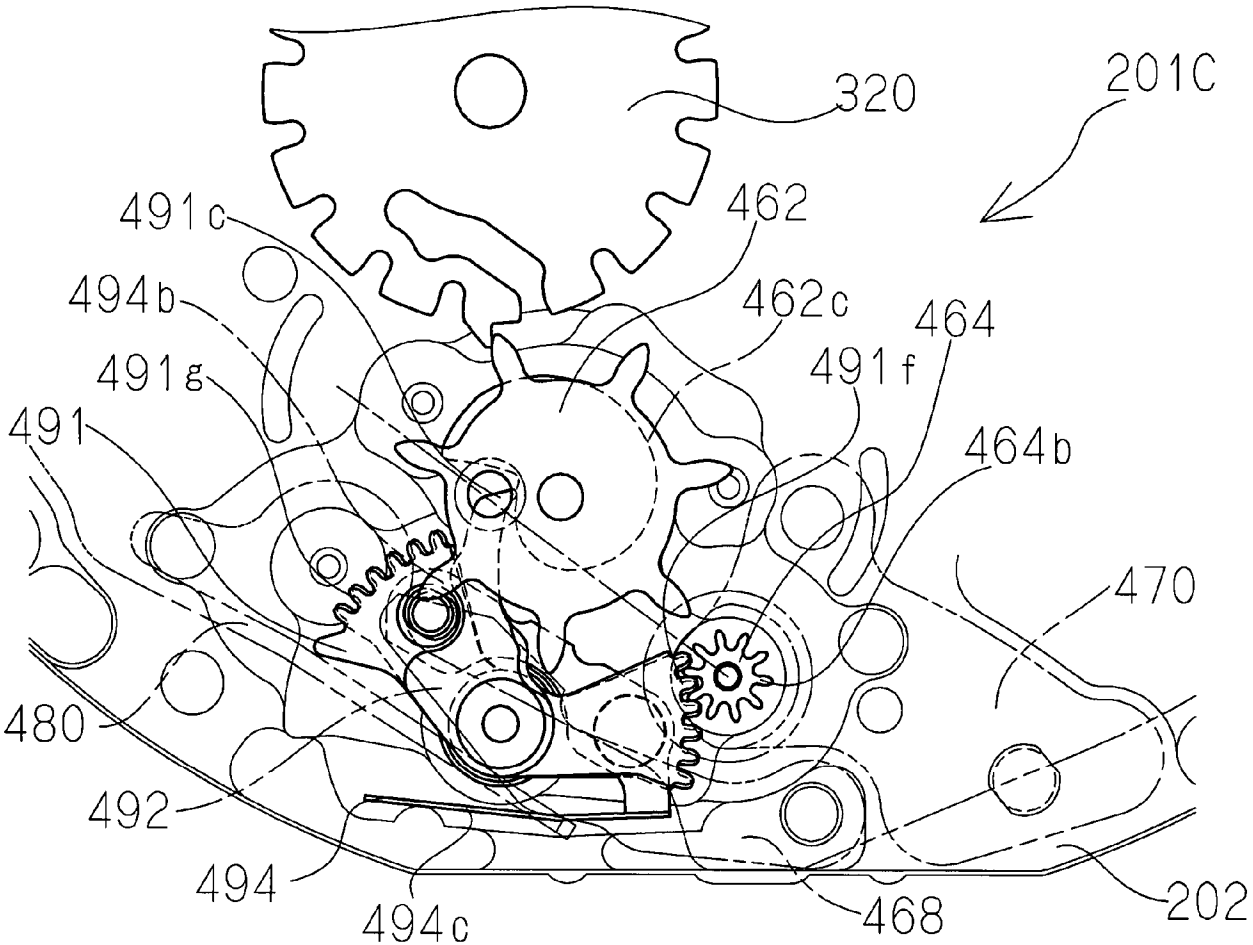
FIG. 19 is an enlarged partial plane view showing a structure of a day feeding mechanism in a state of displaying Sunday according to a third embodiment of a multifunction timepiece of the invention.
Figure 20:
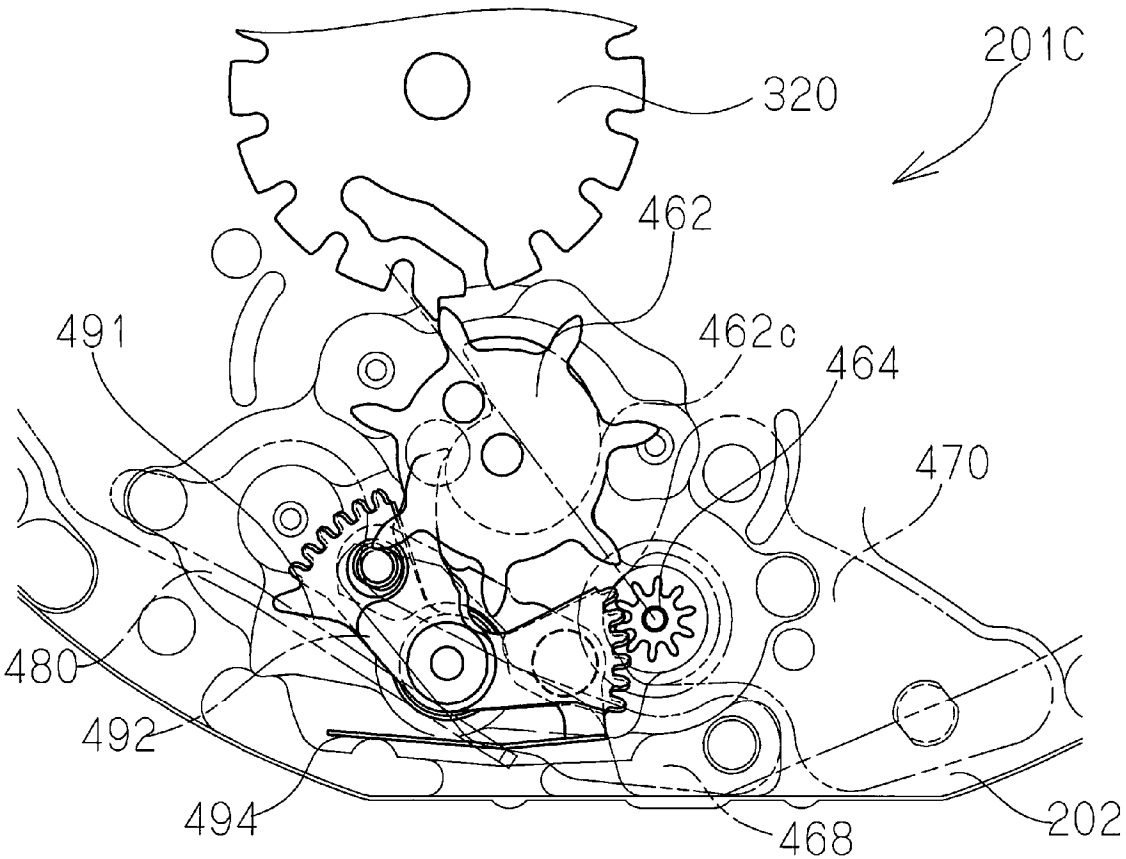
FIG. 20 is an enlarged partial plane view showing the structure of the day feeding mechanism in a state of displaying Monday according to the third embodiment of the multifunction timepiece of the invention.

Next, in reference to FIG. 20, when the date indicator feeding claw 320*f* rotates the date indicator transmission wheel 462*b* of the date indicator transmission wheel 462 by one day, that is, (1/7) by rotating the hour wheel 262 from the state of indicating "Sun" representing "Sunday" shown in FIG. 19, the first hammer 491 is rotated by one day from the state of indicating "Sun". The position in the rotational direction of the day indicator transmission wheel 462 is stopped by the day jumper 468 rotatably provided to the main plate 202. The first operating wheel portion 491*f* of the first hammer 491 rotates the small day wheel 464 by one day to bring about a state of indicating "Mon" representing "Monday". By the spring force of the return spring portion 494*c*, the small day wheel 464 always receives the force of the rotating in the counterclockwise direction via the second hammer 492. The first hammer 491 always receives the force of rotating in the clockwise direction. The front end portion of the cam contact portion 491*c* of the first hammer 491 always receives the force of being pressed to the transmission cam portion 462*c* of the day indicator transmission wheel 462. Similarly, everyday, the small day wheel 464 is rotated by one day and from a state of indicating "Mon" representing "Monday", a state of indicating "Tue" representing "Tuesday" is brought about, next, a state of indicating "Wed" representing "Wednesday" is brought about, next, a state of indicating "Thu" representing "Thursday" is brought about, next, a state of indicating "Fri" representing "Friday" is brought about, next, a state of indicating "Sat" representing "Saturday" is brought about, further, the state can be changed to the state of indicating "Sun" representing "Sunday".

Figure 21:
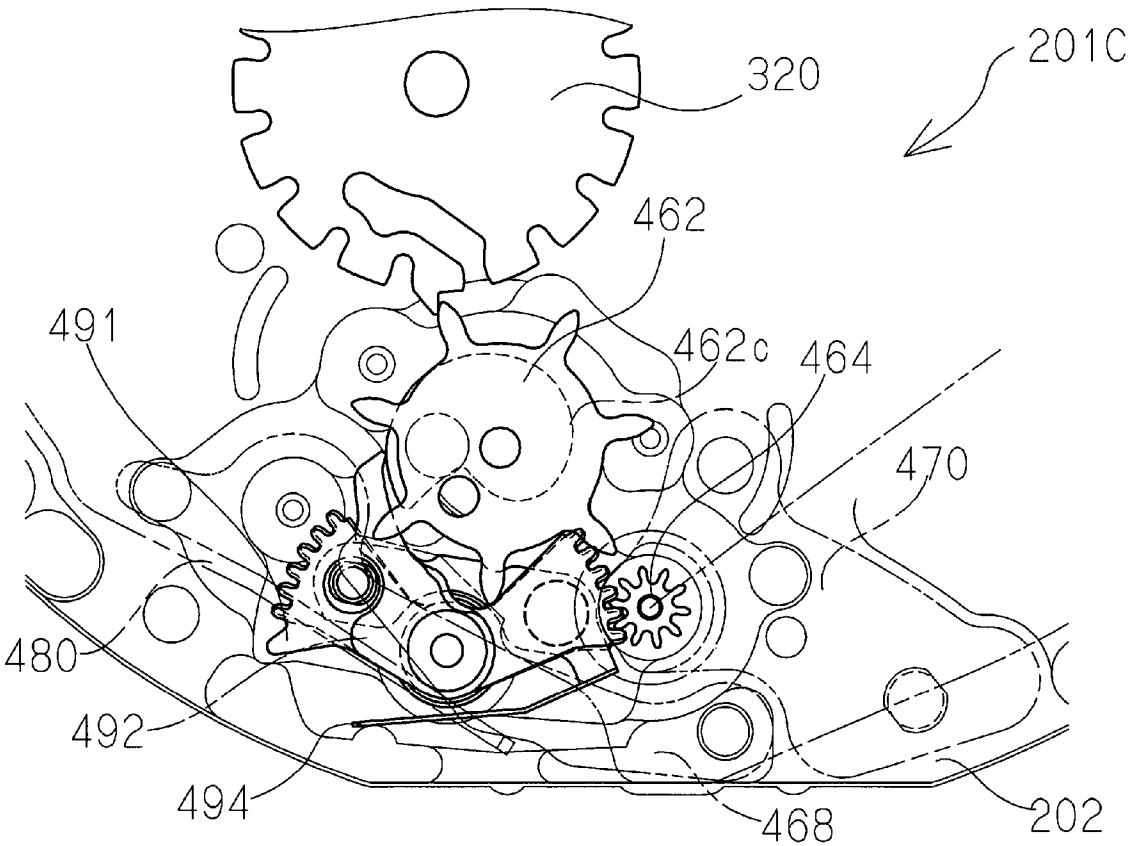
FIG. 21 is an enlarged partial plane view showing the structure of the day feeding mechanism in a state of displaying Saturday according to the third embodiment of the multifunction timepiece of the invention.

In reference to FIG. 21, in the state of indicating "Sat" representing "Saturday" by the small day wheel 464, the front end portion of the cam contact portion 491*c* of the first hammer 491 is pressed to a portion of the transmission cam portion 462*c* of the day indicator transmission wheel 462 proximate to the maximum radius portion. When in a state of indicating "Sat" representing "Saturday", by rotating the hour wheel 262, the day indicator feeding claw 320*f* rotates the day indicator transmission wheel portion 462*b* of the day indicator transmission wheel 462 by one day, that is, (1/7), the front end portion of the cam contact portion 491*c* of the first hammer 491 is moved from the portion of the transmission cam portion 462*c* of the day indicator transmission wheel 462 proximate to the maximum radius portion and is pressed to the portion of the transmission cam portion 462*c* of the day indicator transmission wheel 462 proximate to the minimum radius portion. Further, by adjusting a rotational speed, a period, a speed reducing ratio or the like of a driving apparatus for operating the day indicator feeding mechanism, there can be realized a display apparatus for displaying not only display of day, but also time information ("hour", "minute" or the like), information of display of day, display of month, display of year, display of lunar phase or the like to be easy to see by a small hand moved in a fan shape by applying a structure of adopting the day indicator feeding mechanism.

(1.16) Operation of Date Correction Mechanism:

Operation of a date correction mechanism will be explained as follows. In reference to FIG. 1, FIG. 2, FIG. 4 and FIG. 6, when in a state of pulling out the hand setting stem 210 from 0 stage to 1 stage, the hand setting stem 210 is rotated in one direction and the fourth corrector setting transmission wheel 354 is moved in a direction of being proximate to the day corrector setting wheel 355 via rotation of the first corrector setting transmission wheel 351, the second corrector setting transmission wheel 352 and the third corrector setting transmission wheel 353, the wheel portion of the fourth corrector setting transmission wheel 354 can be brought in mesh with the wheel portion of the date corrector setting wheel 355. Therefore, date can be corrected by rotating the date star wheel 312 by rotating the hand setting stem 210 in one direction in a state of pulling out the hand setting stem 210 to 1 stage.

When in a state of pulling out the hand setting stem 210 to 1 stage, the hand setting stem 210 is rotated in other direction, the fourth corrector setting transmission wheel 354 is moved in a direction of being remote from the date corrector setting wheel 355 via rotation of the first corrector setting transmission wheel 351, the second corrector setting transmission wheel 352 and the third corrector setting transmission wheel 353. In the state, the wheel portion of the fourth corrector setting transmission wheel 354 is not brought in mesh with the wheel portion of the date corrector setting wheel 355. Therefore, even when the hand setting stem 210 is rotated in other direction in the state of pulling the hand setting stem 210 to 1 stage, the date star wheel 312 cannot be rotated and date cannot be corrected.

(1.17) Operation of Hand Setting:

Operation of hand setting will be explained as follows. In reference to FIG. 4, in a state of pulling out the hand setting stem 210 to 2 stage, the A teeth 274*a* of the clutch wheel 274 is brought in mesh with the setting wheel 278. When the hand setting stem 210 is pulled out to 2 stage, the spring portion of the hammer 250 is rotated and is brought into contact with the reset lever 252. Thereby, the spring portion of the hammer 250 is conducted with the reset pattern of the circuit board 224 via the reset lever 252, operation of the integrated circuit 230 is reset and at the same time, the hammer 250 stops the fourth wheel & pinion 240. By rotating the hand setting stem 210 in the state of pulling out the hand setting stem 210 to 2 stage, the setting wheel 278 is rotated via rotation of the clutch wheel 274. By rotating the setting wheel 278, the center pinion of the center wheel & pinion 244 and the hour wheel 262 are rotated via rotation of the minute wheel 260. When hand setting is carried out in the state of pulling out the hand setting stem 210 to 2 stage, the center pinion of the center wheel & pinion 244 can be slipped relative to the center wheel of the center wheel & pinion 244. By rotating the center pinion by rotating the hand setting stem 210, the minute hand 244*h* is rotated, and by rotating the hour wheel 262, the hour hand 262*h* is rotated and therefore, time display (display of "hour" and "minute") can be corrected.

Figure 11:
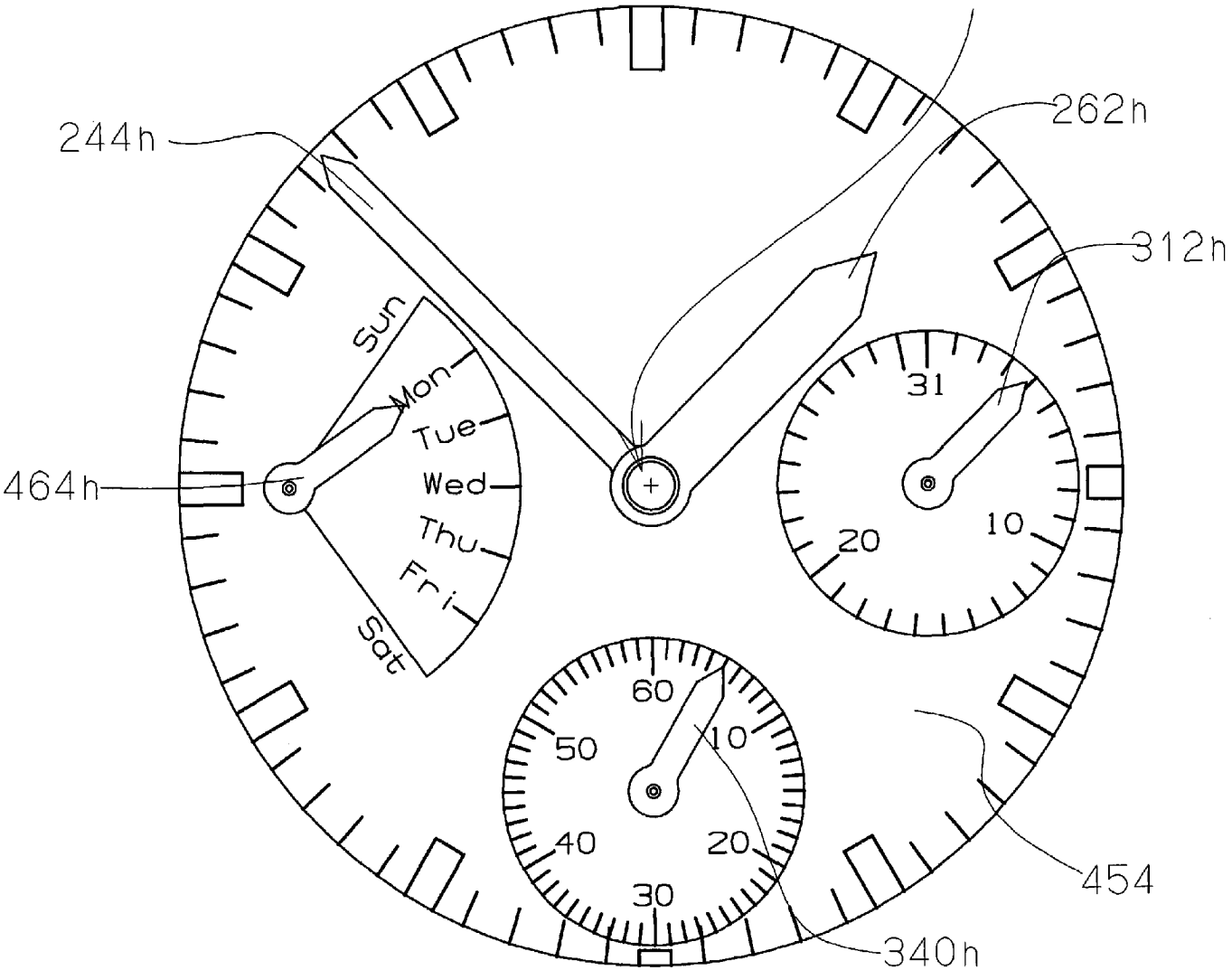
FIG. 11 is a plane view showing a dial and portions of hands of a complete having three small hands according to the first embodiment of the multifunction timepiece of the invention.

(1.18) Explanation of Hand Position and Hand Specification:

In reference to FIG. 10 and FIG. 11, in a first kind of the embodiment of the multifunction timepiece, it is possible that by the hour hand 262*h* attached to the hour wheel 262 the rotational center of which is the main plate center 202*c*, time information with regard to "hour" of the 12 hour system is displayed, by the minute hand 244*h* attached to the center wheel & pinion 244 the rotational center of which is the main plate center 202*c*, time information with regard to "minute" is displayed, by the small second hand 340*h* attached to the second indicator 340 the rotational center of which is arranged in "6 o'clock direction", time information with regard to "second" is displayed, by the date hand 312*h* attached to the date star wheel 312 the rotational center of which is arranged in "3 o'clock direction", calendar information with regard to "date" is displayed, by the day hand 464*h* attached to the small day indicator 464 the rotational center of which is arranged in "9 o'clock direction" and capable of moving in a fan shape, calendar information with regard to "day" can be displayed by so-to-speak "retrograde type". For example, the day hand 464*h* can display calendar information with regard to "day" in a range of 90 degrees through 160 degrees. In view from allowance of design of constituent parts and design performance of day display, it is preferable that the day hand 464*h* displays calendar information with regard to "day" in a range of 100 degrees through 120 degrees.

It is preferable to constitute to equalize a distance from the main plate center 202*c* to the date hand 312*h*, a distance from the main plate center 202*c* to the rotational center of the small second hand 340*h*, and a distance from the main plate center 202*c* to the rotational center of the 24 hour hand 330*h*. However, the distances between the centers can also be constituted not to be equal. It is preferable to constitute the distance from the main plate center 202*c* to the rotational center of the day hand 464*h* larger than the distance from the main plate center 202*c* to the rotational center of the date hand 312*h*. It is preferable to constitute the distance from the main plate center 202*c* to the rotational center of the day hand 464*h* larger than the distance from the main plate center 202*c* to the rotational center of the 24 hour hand 330*h*. It is preferable to constitute the distance from the main plate center 202*c* to the rotational center of the day hand 464*h* larger than the distance from the main plate center 202*c* to the rotational center of the small second hand 340*h*.

The dial 454 is provided with a character, a numeral, an abbreviated character or the like for displaying respective time information, calendar information. For example, in order to display calendar information with regard to "date", numerals of "10", "20", "31" are provided along a circumference at positions of the dial 454 in correspondence with the date hand 312*h*. For example, in order to display time information with regard to "second", numerals of "10", "20", "30", "40", "50", "60" are provided along a circumference at positions in correspondence with the small second hand 340*h* of the dial 454. For example, in order to display calendar information with regard to "day". English letters of "Sun", "Mon", "Tue", "Wed", "Thu", "Fri", "Sat" are provided along a circumference at positions in correspondence with the day hand 464*h* of the dial 454. Or, in order to display calendar information with regard to "day", numerals, Japanese letters, foreign language letters, Roman numerals, signs or the like can also be used.

Figure 12:
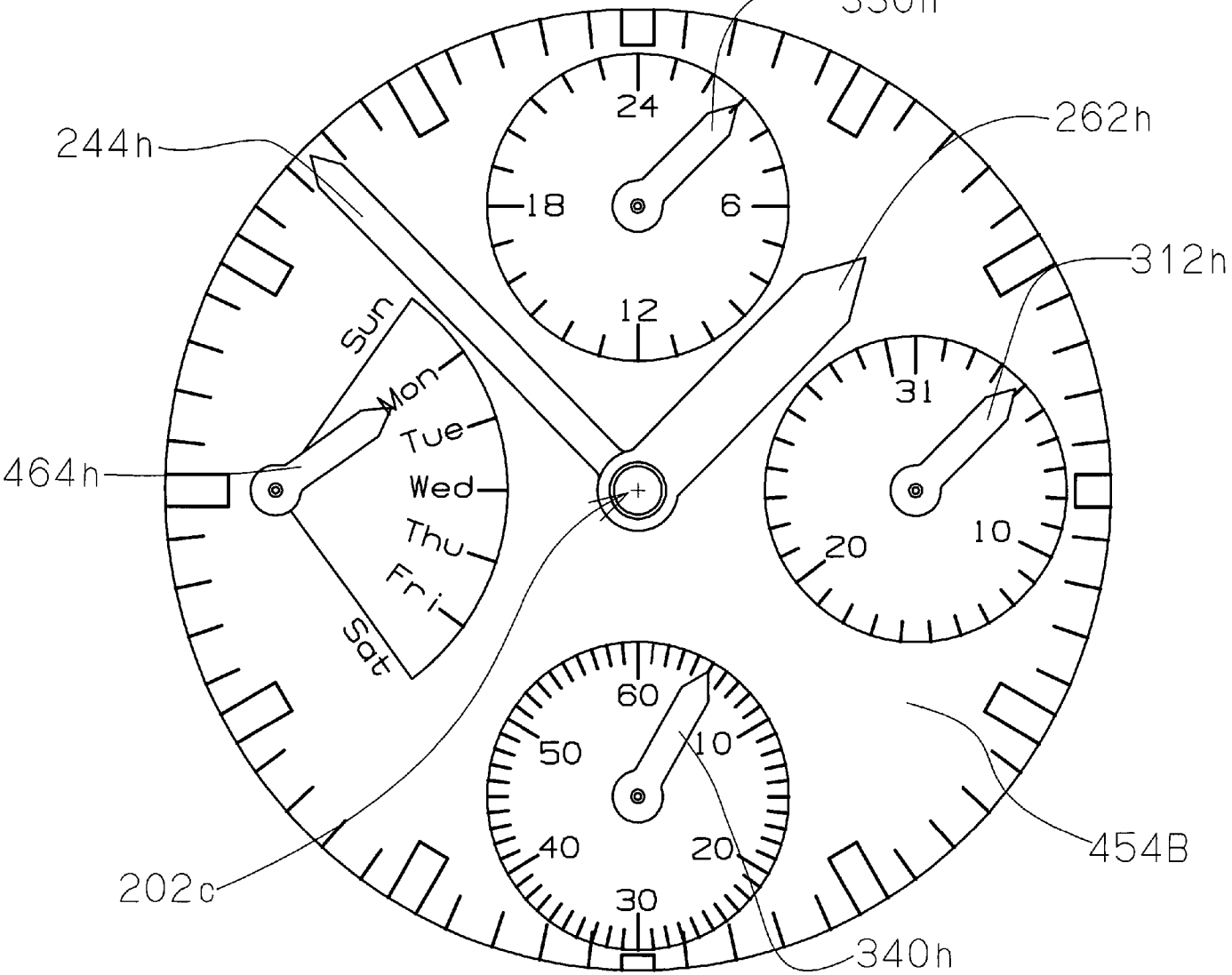
FIG. 12 is a plane view showing a dial and portions of hands of a complete having four small hands according to the first embodiment of the multifunction timepiece of the invention.

In reference to FIG. 10 and FIG. 12, in a second kind of the embodiment of the multifunction timepiece, it is possible that by the hour hand 262*h* attached to the hour wheel 262 the rotational center of which is the main plate center 202*c*, time information with regard to "hour" of the 12 hour system is displayed, by the minute hand 244*h* attached to the center wheel & pinion 244 the rotational center of which is the main plate center 202*c*, time information with regard to. "minute" is displayed, by the small second hand 340*h* attached to the second indicator 340 the rotational center of which is arranged in "6 o'clock direction", time information with regard to "second" is displayed, by the 24 hour hand 330*h* attached to the hour indicator 330 the rotational center of which is arranged in "12 o'clock direction", time information with regard to "hour" of the 24 hour system is displayed, by the date hand 312*h* attached to the date hour wheel 312 the rotational center of which is arranged in "3 o'clock direction", calendar information with regard to "date" is displayed, by the day hand 464*h* attached to the small day indicator 464 the rotational center of which is arranged in "9 o'clock direction" and capable of moving in a fan shape, calendar information with regard to "day" can be displayed by so-to-speak "retrograde type". For example, in order to display time information with regard to "hour" of the 24 hour system, numerals of "6", "12", "18", "24" are provided along a circumference at positions in correspondence with the 24 hour hand 330*h* of the dial 454B.

For example, in order to display calendar information with regard to "day", English letters of "Sun", "Mon", "Tue", "Wed", "Thu", "Fri", "Sat" can be displayed substantially in a fan shape along a circumference at positions in correspondence with the day hand 464*h* of the dial 454B. Or, in order to display calendar information with regard to "day", numerals, Japanese letters, foreign language letters, Roman numerals, signs or the like can be used. Further, a third kind of the embodiment of the multifunction timepiece illustrated in FIG. 10 will be described later.

(1.19) Embodiment of Mechanical Timepiece:

Although as described above, an explanation has been given of the first embodiment of the multifunction timepiece with regard to the movement of the analog electronic timepiece, according to the invention, the movement can be constituted by a mechanical timepiece with regard to any embodiment. As a modified example, in reference to FIG. 13 through FIG. 15, in an embodiment of a mechanical timepiece, a movement 20 includes a main plate 22 constituting a base plate of the movement 20. According to an embodiment of the mechanical timepiece, a top train wheel of a barrel complete, a center wheel & pinion, a third wheel & pinion, a fourth wheel & pinion and the like, an automatic winding mechanism of an oscillating weight, a claw lever or the like, and a switching mechanism of a setting lever, a yoke and the like are respectively integrated to the top side of the movement 20. In the embodiment of the mechanical timepiece, a structure of a back side of the movement can be constituted similar to the structure of the back side of the movement of the analog electronic timepiece shown in FIG. 1 and FIG. 2.

A structure of the train wheel will be explained as follows. A center wheel & pinion 24 is rotatably integrated at substantially a center of the main plate 22. The center wheel & pinion 24 is integrated between the main plate 22 and a second bridge 26. A cannon pinion 28 is integrated to a dial side of the main plate 22 to be able to slip at an outer peripheral portion contiguous to affront end of a side of a center wheel & pinion 24 proximate to a hand attaching portion thereof. The cannon pinion. 28 is integrally rotated with the center wheel & pinion 24. A barrel complete 30 is rotatably integrated between the main plate 22 and a first bridge 32. A barrel wheel of the barrel complete 30 is brought in mesh with a center pinion of the center wheel & pinion 24. A third wheel & pinion 34 is rotatably integrated between the main plate 22 and the first bridge 32. A center wheel of the center wheel & pinion 24 is constituted to be brought in mesh with a third pinion. A fourth wheel & pinion 40 is rotatably integrated between the second bridge 26 and the first bridge 32. A third wheel of the third wheel & pinion 34 is constituted to be brought in mesh with a fourth pinion of the fourth wheel & pinion 40. An escape wheel & pinion 50 is rotatably integrated between the main plate 22 and the first bridge 32. A fourth wheel of the fourth wheel & pinion 40 is constituted to be brought in mesh with an escape pinion of the escape wheel & pinion 50. Here, a number of the train wheel is not limited to the above-described but one or more of transmission wheels may further be added.

Figure 18:
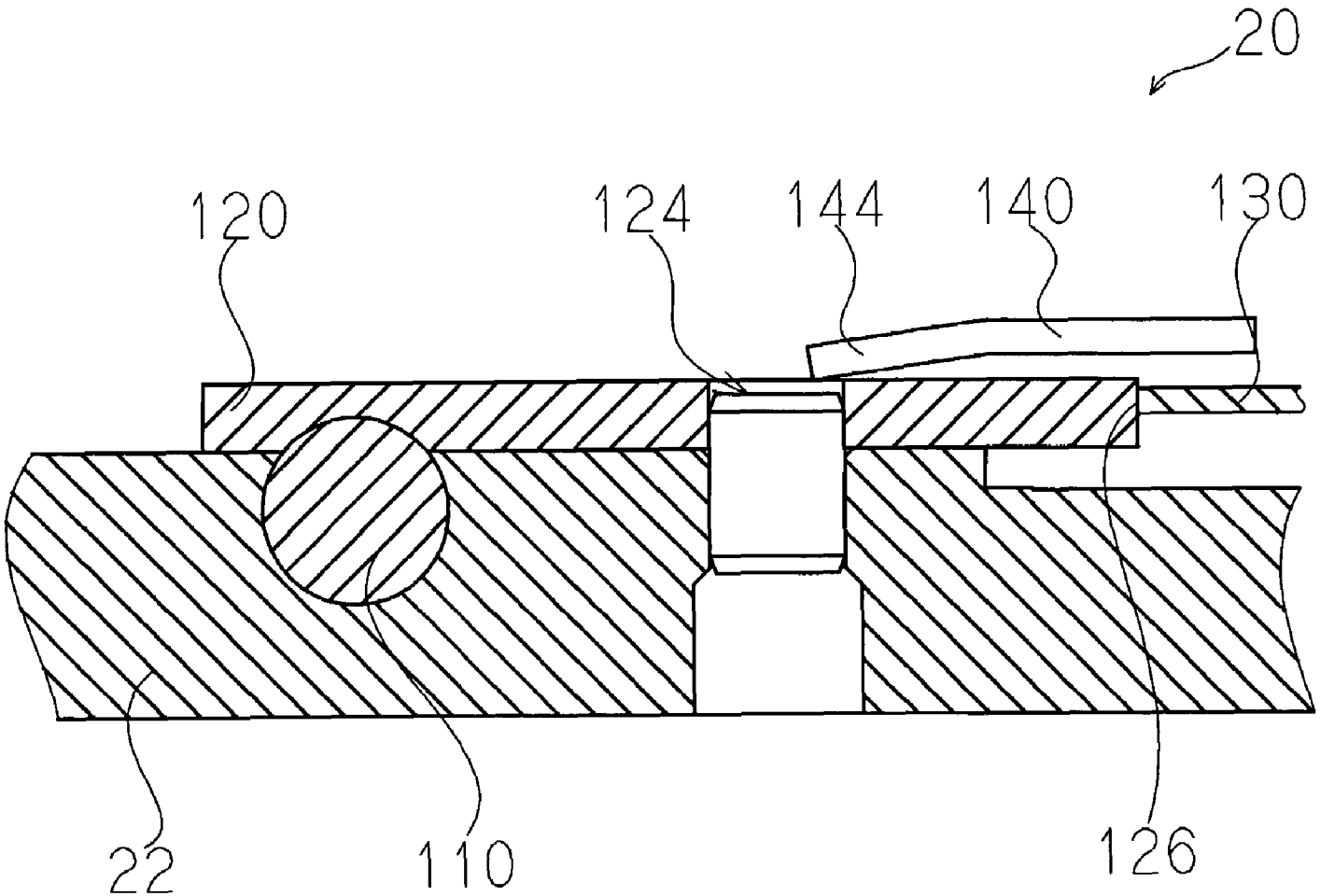
FIG. 18 is a sectional view showing an outline structure of portions of the setting lever and the yoke according to the modified example of the first embodiment of the multifunction timepiece of the invention.

Next, a structure of an escapement speed control mechanism will be explained. In reference to FIG. 13 through FIG. 15, a pallet fork 60 is oscillatably integrated between the main plate 22 and the pallet fork bridge 62. The pallet fork 60 includes two claw jewels 63 and a sharpened tip 64. An escape wheel of the escape wheel & pinion 50 is engaged with the claw jewel 63. A balance with hairspring 70 is rotatably integrated between the main plate 22 and a balance bridge 72. In reference to FIG. 18, the balance with hairspring 70 includes a balance core 71, a hairspring 74, an oscillating jewel 76, a hairspring jewel 78, and a balance wheel 79. The sharpened tip 64 of the pallet fork 60 is constituted to be engaged with the oscillating jewel 76. A center portion of the balance wheel 79 is fixed to the balance core 71. An inner end portion of the hairspring 74 is fixed to the hairspring jewel 78 fixed to the balance core 71. An outer peripheral portion 74*g* of the hairspring 74 is attached to a hair spring holder 72*b*. The hair spring holder 72*b* is attached to a hairspring holder bridge 72*a*. The hairspring holder bridge 72*a* is attached to the balance bridge 72.

Figure 17:
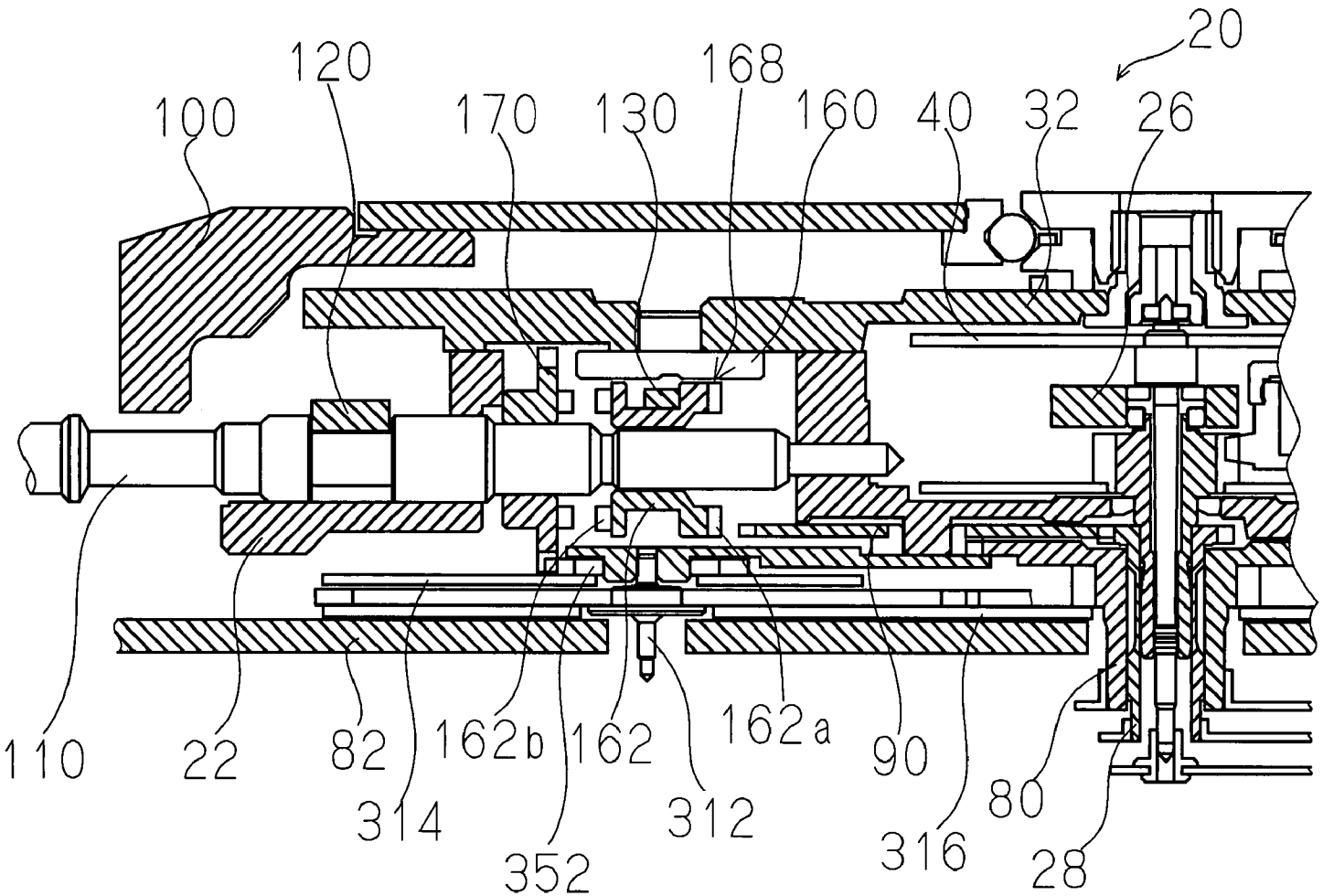
FIG. 17 is a sectional view showing an outline structure of a portion of a hand setting stem according to the modified example of the first embodiment of the multifunction timepiece of the invention.

Next, a structure of a back train wheel will be explained. In reference to FIG. 17, FIG. 20, an hour wheel 80 is rotatably integrated to a side of the main plate 22 having a dial 82. A minute wheel of a minute wheel 90 is rotatably integrated to the side of the main plate 22 having the dial 82. The minute wheel of the minute wheel 90 is brought in mesh with the cannon pinion 28. A minute pinion of the minute wheel 90 is constituted to be brought in mesh with the hour wheel 80. Further, the date indicator driving wheel 310 (refer to FIG. 1) can be constituted to rotate by rotating the minute wheel 80. The day indicator driving wheel 320 (refer to FIG. 1) can be constituted to rotate by rotating the hour wheel 80.

Figure 13:
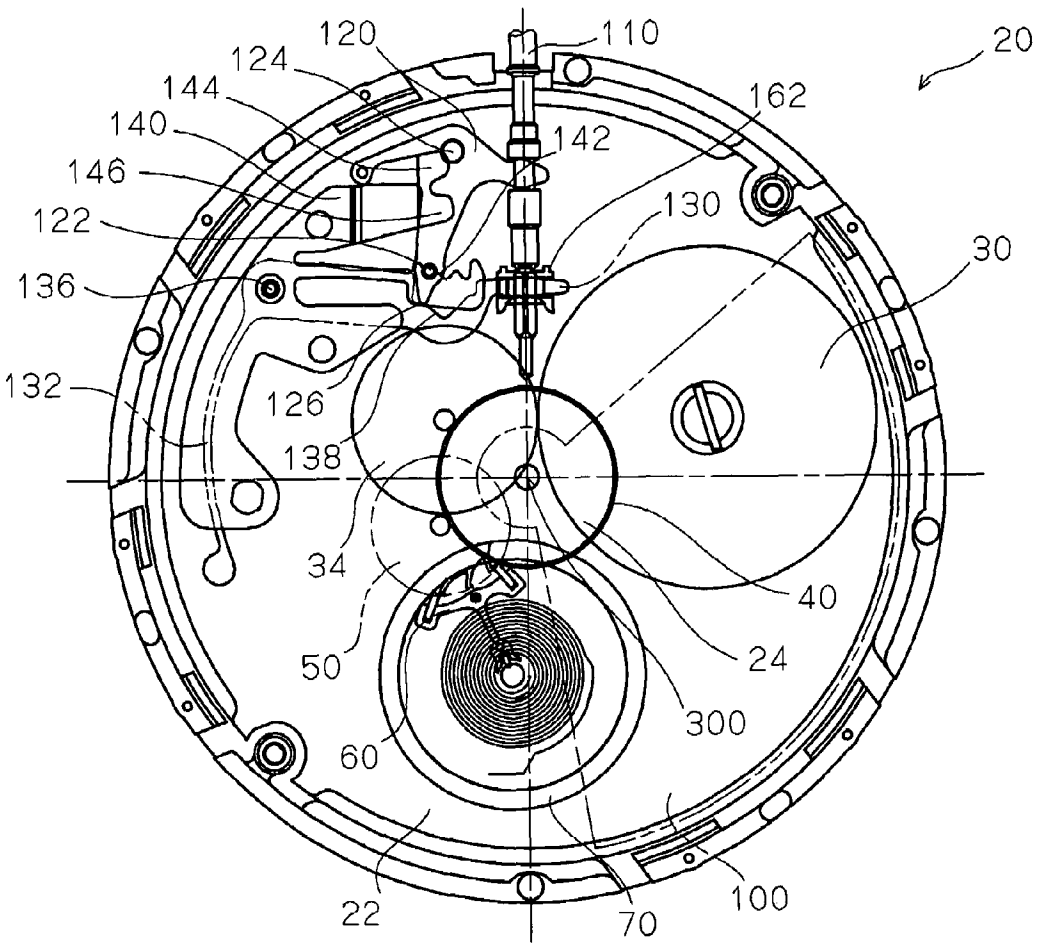
FIG. 13 is a plane view showing an outline structure viewed from a top side of a movement illustrated by omitting an automatic winding apparatus, a bridge member or the like to show clearly according to a modified example of the first embodiment of the multifunction timepiece of the invention.
Figure 14:
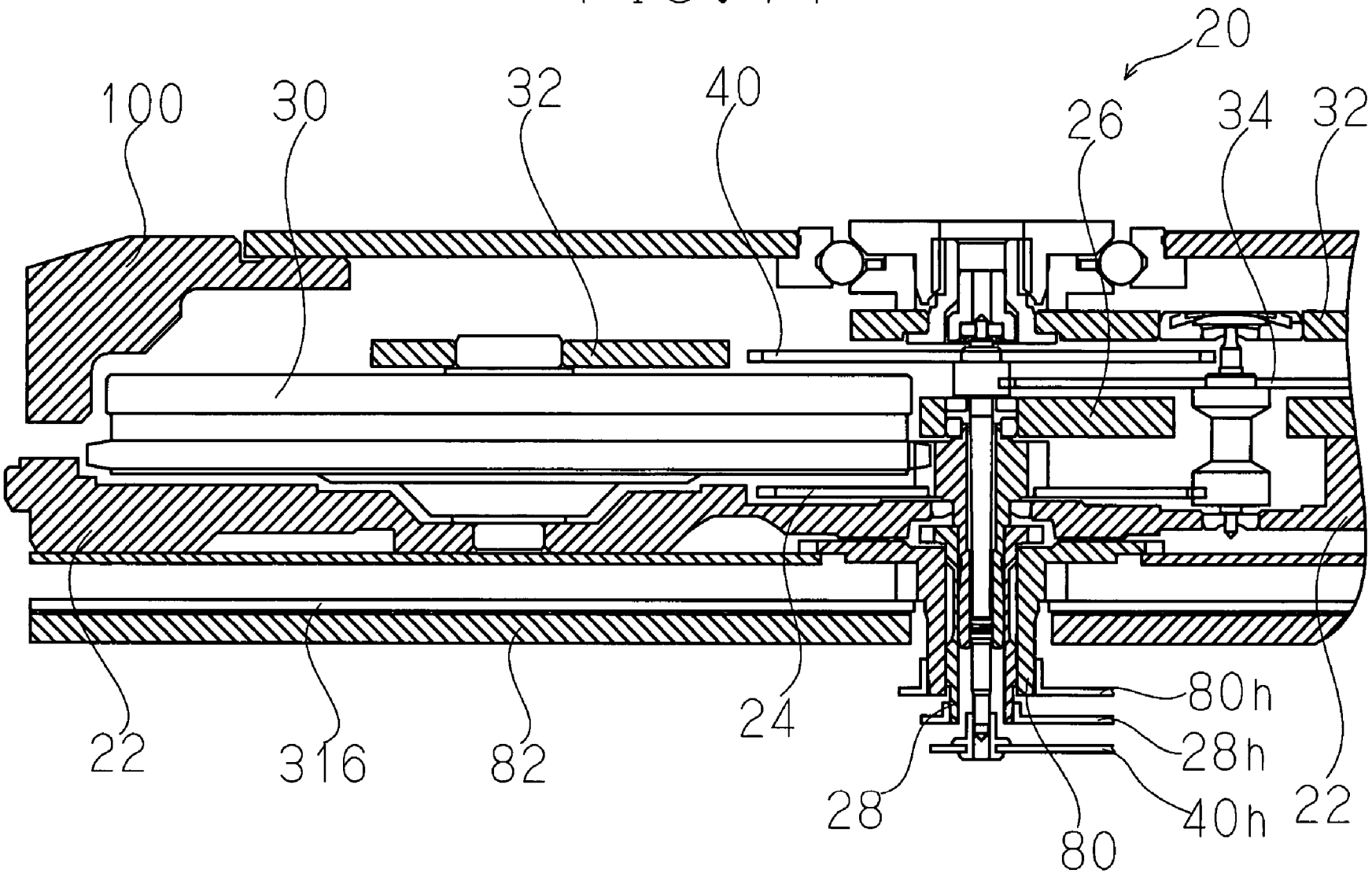
FIG. 14 is a sectional view showing an outline structure of portions of a barrel complete and a top train wheel according to the modified example of the first embodiment of the multifunction timepiece of the invention.
Figure 15:
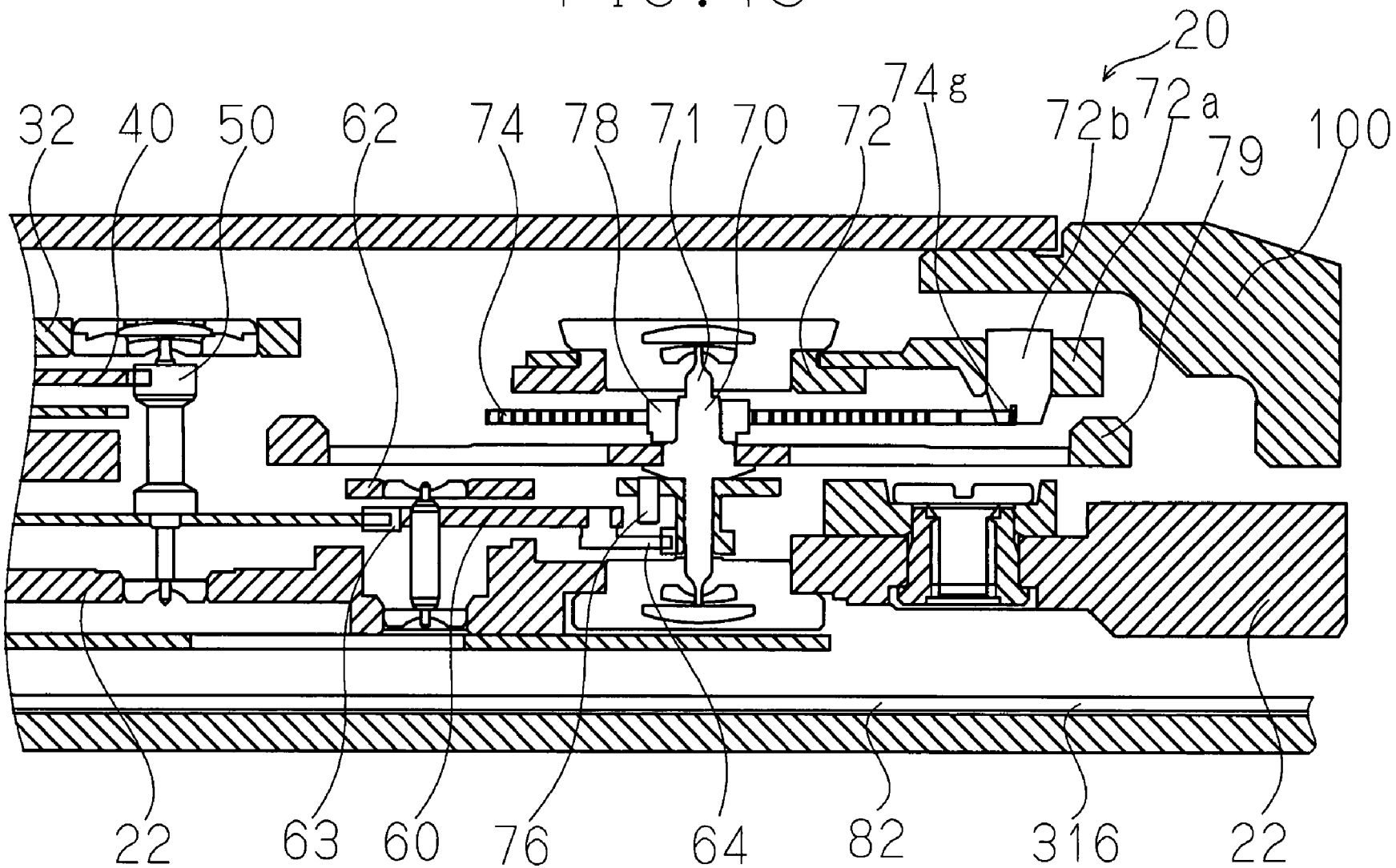
FIG. 15 is a sectional view showing an outline structure of a balance with hairspring, a pallet fork, a portion of the balance with hairspring according to the modified example of the first embodiment of the multifunction timepiece of the invention.
Figure 16:
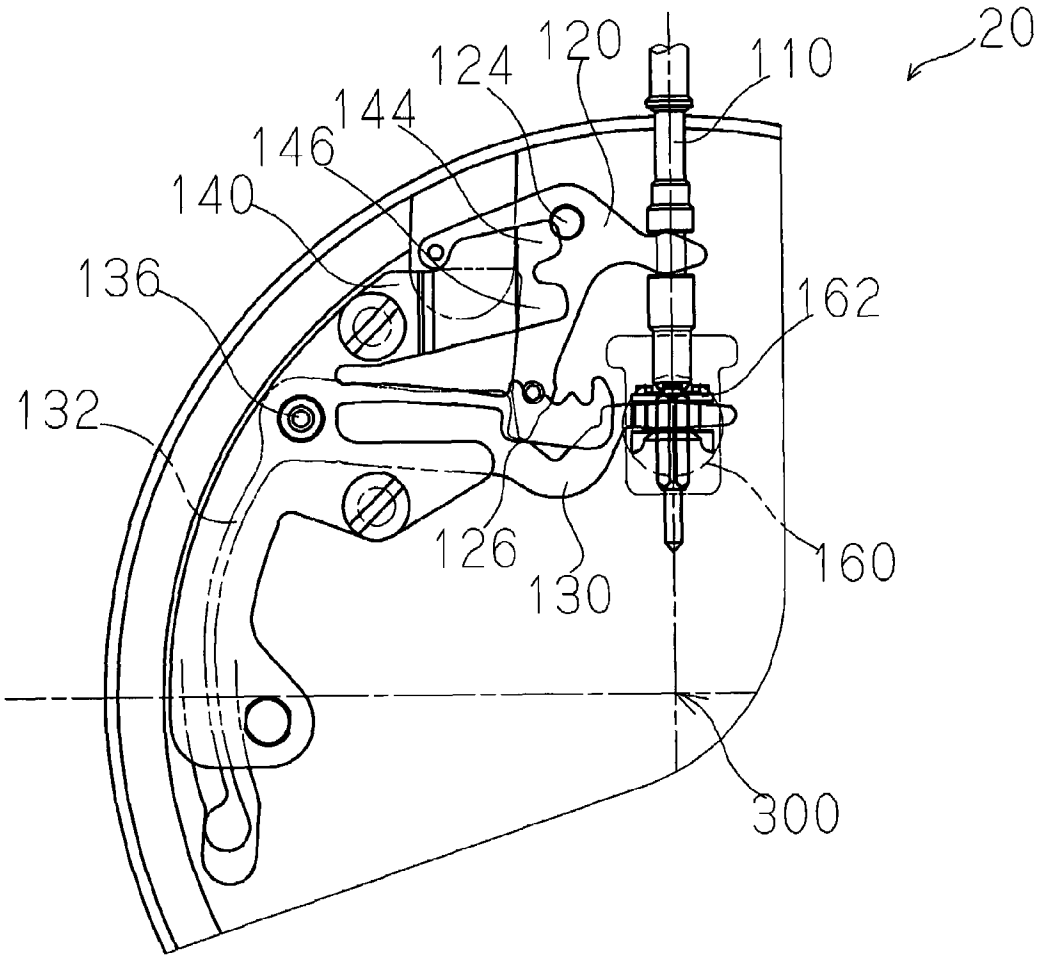
FIG. 16 is a plane view showing an outline structure of portions of a setting lever and a yoke according to the modified example of the first embodiment of the multifunction timepiece of the invention.

In reference to FIG. 13 through FIG. 15, an oscillating weight 100 is rotatably integrated to the first bridge 32. The oscillating weight 100 is integrated to the first bridge 32 via a ball bearing (not illustrated). A first transmission wheel (not illustrated) is rotatably integrated to be brought in mesh with a pinion (not illustrated) of the oscillating weight 100. A claw lever (not illustrated) is rotatably integrated to an eccentric cam portion (not illustrated) of the first transmission wheel. A second transmission wheel (not illustrated) is rotatably integrated to the claw lever to be engaged with a claw portion (not illustrated). Ratchet teeth (not illustrated) of the second transmission wheel are constituted to be engaged with the claw portion of the claw lever. It is constituted that the first transmission wheel (not illustrated) is rotated based on rotation of the oscillating weight 100 and based on operation of the claw lever, the second transmission wheel is rotated only in a predetermined direction. The mainspring is constituted to be wound based on rotation of a second winding transmission wheel (not illustrated).

In reference to FIG. 13, FIG. 16 through FIG. 18, it is preferable to fabricate the pallet fork holder 140 by an elastically deformable material, for example, fabricated by stainless steel. It is preferable to fabricate the pallet fork 130 by an elastically deformable material, for example, fabricated by stainless steel. A spring portion 132 of the pallet fork 130 may be any shape of a linear shape, a bent shape, a U-like shape or the like. A ridge portion 142 of the pallet fork holder 140 is engaged with a positioning pin 122 of a setting lever 120 to determine a position of the setting lever 120 and set a switching weight of the barrel complete 110. According to the mechanical timepiece of the invention, the ridge portion 142 of the pallet fork holder 140 is constituted to be able to pull out the barrel complete 110 to 1 stage and 2 stage. By a spring force of the spring portion 132 of the pallet fork 130, a guide valley portion 138 of the pallet fork 130 is pressed to a side face of a front end portion of the setting lever 120.

Next, operation of the embodiment of the mechanical timepiece will be explained. In reference to FIG. 13 through FIG. 15, by a force of the mainspring (not illustrated), the barrel complete 30 is rotated. The center wheel & pinion 24 is rotated by rotation of the barrel complete 30. The third wheel & pinion 34 is rotated by rotation of the center wheel & pinion 24. The fourth wheel & pinion 40 is rotated by rotation of the third wheel & pinion 34. Further, the cannon pinion 28 is simultaneously rotated by rotation of the second wheel & pinion 24. The minute wheel 90 is rotated by rotation of the cannon pinion 28. The hour wheel 80 is rotated by rotation of the minute wheel 90. Rotational speeds of the respective train wheels are controlled by operation of the balance with hairspring 70, the pallet fork 60 and the escape wheel & pinion 50. As a result, the fourth wheel & pinion 40 is rotated by one rotation per minute. The hour pinion 28 and the center wheel & pinion 24 are rotated by one rotation per hour. The hour wheel 80 is rotated by one rotation per 12 hours.

"Second" is displayed by a second hand 40*h* attached to the fourth wheel & pinion 40. "Minute" is displayed by a minute hand 28*h* attached to the cannon pinion 28. "Hour" is displayed by an hour hand 80*h* attached to the hour wheel 80. That is, the fourth wheel & pinion 40, the cannon pinion 28 and the center wheel & pinion 24, the hour wheel 80 constitute display wheels for displaying time information. Time can be read by the hour hand 80*h*, the minute hand 28*h*, the second hand 40*h* and graduations or the like of the dial 82. Next, winding of the mainspring by the automatic winding mechanism will be explained. The mechanical timepiece is carried by the wrist. The wrist is waved forward and rearward. Based on rotation of the oscillating weight 100, the claw lever is operated as in operating an eccentric cam and the mainspring can be wound by rotating the automatic winding transmission wheel (not illustrated) or the like having the ratchet teeth.

Next, operation of the switching mechanism will be explained. In reference to FIG. 13, FIG. 16 through FIG. 18, normally, when the mechanical timepiece is carried by the wrist, the hand setting stem 110 is disposed at 0 stage. Next, in correcting calendar, the hand setting stem 110 is pulled out to 1 stage. At this occasion, the setting lever 120 is rotated. The pallet fork 130 is rotated by a spring force of the pallet fork to bring B teeth 162*b* of a clutch wheel 162 in mesh with a first corrector setting transmission wheel 170. When the hand setting stem 110 is rotated under the state, the clutch wheel 162 is rotated, and when a fourth corrector setting transmission wheel 354 is moved in a direction of being proximate to a date corrector setting wheel 355 by rotation of a first corrector setting transmission wheel 170 via rotation of the second corrector setting transmission wheel 352, the third corrector setting transmission wheel 353, a wheel portion of the fourth corrector setting transmission wheel 354 can be brought in mesh with a wheel portion of the date corrector setting wheel 355. Therefore, in a state of pulling out the hand setting stem 210 to 1 stage, date can be corrected by rotating the date star wheel 312 by rotating the hand setting stem 110 in one direction.

Next, in correcting time, the hand setting stem 110 is further pulled out to 2 stage. At this occasion, the setting clutch 120 is further rotated. The pallet fork 130 is rotated in a direction reverse to the above-described rotation by the spring force of the pallet fork to bring the A teeth 162*a* of the clutch wheel 162 in mesh with the minute wheel 90. When the hand setting stem 110 is rotated under the state, the clutch wheel 162 is rotated and time display can be corrected by rotating the cannon pinion 28 and the hour wheel 80 by rotation of the minute wheel 90.

In reference to FIG. 13 through FIG. 15, FIG. 17, the hour wheel 80 is rotated based on rotation of the minute wheel 90. The hour wheel 80 is rotated by one rotation per 12hours. By rotation of the hour wheel 80, the date indicator driving wheel 310 is rotated. By the date feeding claw 310*f* provided at the date indicator driving wheel 310, the date star wheel 312 is rotated once per day, (1/31). The date star wheel 312 is constituted to rotate by one rotation per 31 days. By rotation of the hour wheel 262, the day indicating driving wheel 320 is rotated. By the day feeding claw 320*f* provided at the date indicator driving wheel 320, the small day wheel 322 is rotated by once per day, (1/7). The small day wheel 322 is rotated by one rotation per 7 days. Further, by rotation of the day indicator driving wheel 320, the hour indicator 330 is rotated. The hour indicator 330 is rotated by one rotation per 24 hours. According to a constitution of displaying "second" by the second hand 40*h* attached to the fourth wheel & pinion 40, the second indicator 340, the small second hand 340*h* can be omitted. Or, according to the constitution of displaying "second" by the small second hand 340*h*, the second hand 40*h* can be omitted.

(2) Second Embodiment

Next, a second embodiment of the multifunction timepiece will be explained. The following explanation will be described mainly on a point in which the second embodiment of the multifunction timepiece differs from the first embodiment of the multifunction timepiece. Therefore, the above-described explanation of the first embodiment of the multifunction timepiece will be applied to a portion which is not described below.

Figure 22:
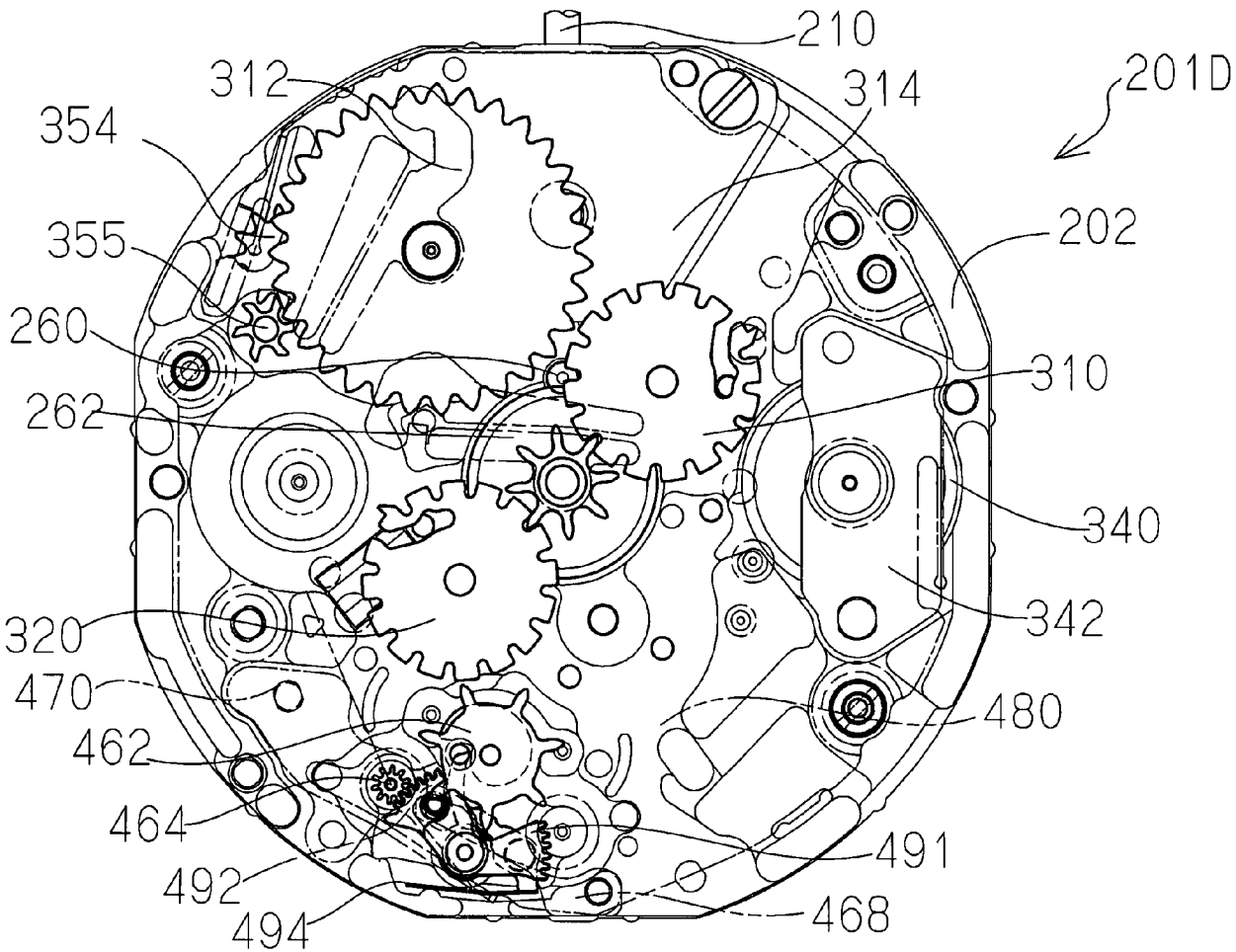
FIG. 22 is a plane view showing an outline structure viewed from a back side of a movement according to a second embodiment of a multifunction timepiece of the invention.
Figure 23:
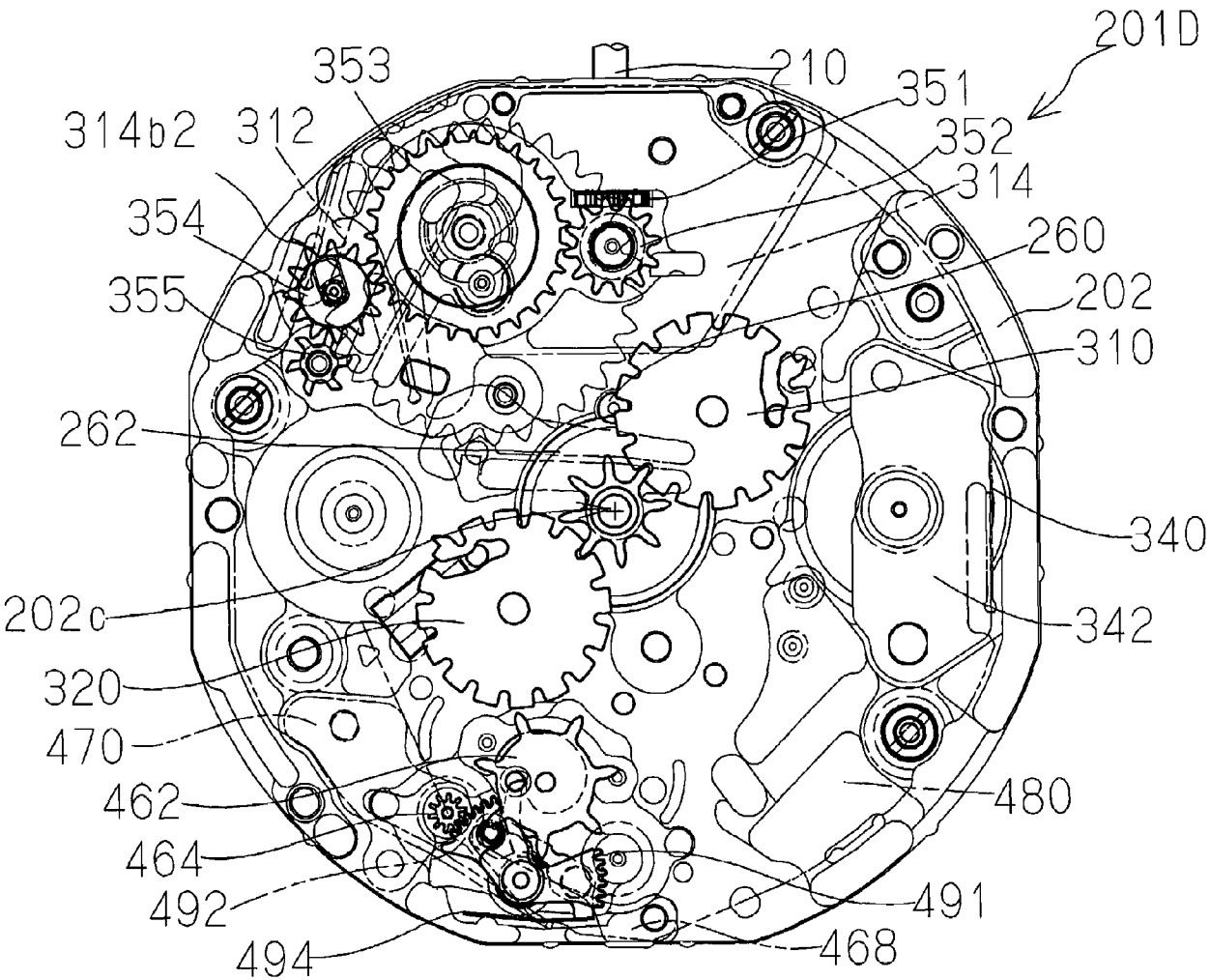
FIG. 23 is a plane view showing a date, correcting mechanism of the back side of the movement according to the second embodiment of the multifunction timepiece of the invention.

(2.1) Structure of Total of Movement:

In reference to FIG. 22 and FIG. 23, the second embodiment is constituted by an analog electronic timepiece. Further in details, the second embodiment of the multifunction timepiece of the invention is constituted by an analog timepiece (electric timepiece, electronic timepiece, mechanical timepiece) having a small hand capable of being moved to rotate at at least one portion in "2 o'clock direction", "6 o'clock direction" and having a small hand capable of being moved in a fan shape in "10 o'clock direction". That is, the second embodiment of the multifunction timepiece of the invention can be constituted such that time information with regard to "hour" of a 12 hour system is displayed by an hour hand the rotational center of which is a center of the main plate, time information with regard to "minute" is displayed by a minute hand the rotational center of which is a center of the main plate, calendar information with regard to "date" is displayed by a date hand the rotational center of which is arranged in "2 o'clock direction", time information with regard to "second" is displayed by a small second hand the rotational center of which is arranged in "6 o'clock direction", and calendar information with regard to "day" is displayed by so-to-speak "retrograde type" by a day hand the rotational center of which is arranged in "10 o'clock direction" and capable of being moved in a fan shape.

As a modified example of the second embodiment, a movement can also be constituted by a mechanical timepiece. As a further modified example, the second embodiment can also be constituted such that a movement is constituted by an analog electronic timepiece or a mechanical timepiece, and time information with regard to "second" can be displayed by a second hand the rotational center of which is a center of the main plate. According to the further modified example, a small second hand can be omitted.

According to the second embodiment, a movement 201D is provided with the main plate 202. A power source portion, a circuit portion, a converter (step motor), a top train wheel, a switching mechanism and the like are arranged on the case back side (top side) of the main plate 202. Aback train wheel, a calendar train wheel, a date correction mechanism and the like are arranged on the back side of the main plate 202. A dial 454C is arranged on a glass side of the main plate 202. The hand setting stem 210 is arranged rotatably on 3 o'clock side of the main plate 202. The point in which the second embodiment differs from the first embodiment resides in that a date display mechanism is arranged in "2 o'clock direction", a day display mechanism is arranged in "10 o'clock direction", and a 24 hour display mechanism is not provided. All of parts of the movement used in the second embodiment are the same as parts of the movement used in the first embodiment. The dial 454C used in the second embodiment differs from the dial 454 used in the first embodiment and differs from the dial 454B used in the first embodiment.

(2.2) Structure of Date Display Mechanism:

Next, a structure of a date display mechanism will be explained. In reference to FIG. 22 and FIG. 23, in the movement 201D, a date indicator feeding mechanism is constituted to operate based on rotation of the hour wheel 262. The date display mechanism includes the date indicator driving wheel 310 and the date star wheel 312. The date indicator driving wheel 310 is constituted to rotate by rotation of the hour wheel 262. The date indicator driving wheel 310 is rotatably supported by a second date indicator driving wheel pin provided at the main plate 202. It is preferable to arrange the rotational center of the date indicator driving wheel 310 at a region between "4 o'clock direction" and "5 o'clock direction" (that is, "4-5 o'clock region").

Figure 6:
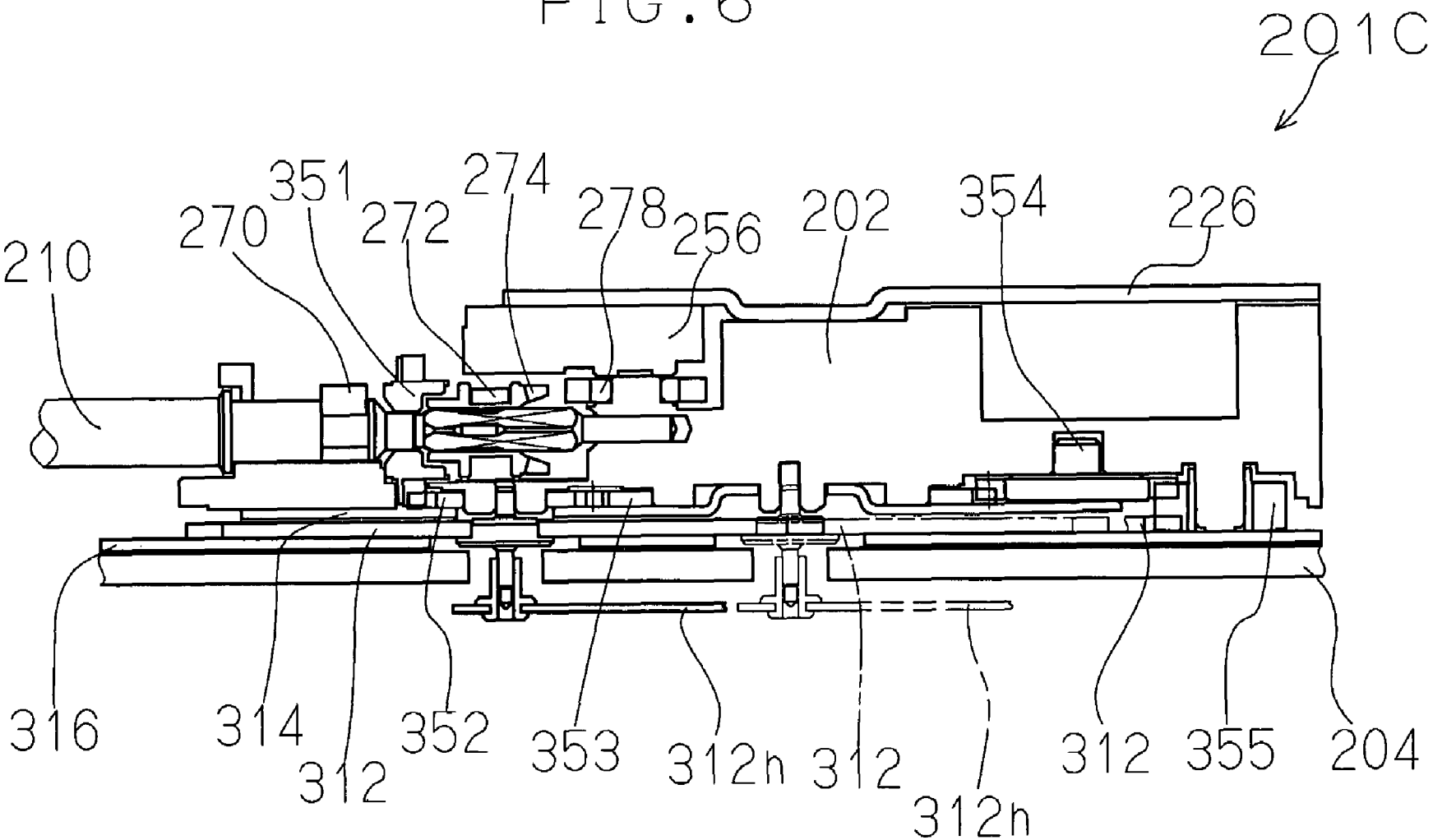
FIG. 6 is a partial sectional view showing portions of the hand setting stem and the date correcting mechanism according to the first embodiment of the multifunction timepiece of the invention.

In reference to FIG. 6 and FIG. 22, a portion of the date corrector setting transmission wheel holder 314 disposed on the lower side of the date star wheel 312 is narrowed in the circular shape toward a back face of the main plate 202. It is preferable to fit the hole provided at the center of the circular narrowed portion of the date corrector setting transmission wheel holder 314 to the date corrector setting transmission wheel holder guide shaft portion provided at the surrounding of the date star wheel guide hole. The position in the rotational direction of the date star wheel 312 is stopped by a second date jumper 480*b* provided at the back object holder 480. It is preferable to arrange the stopping portion provided at the a front end of the spring portion of the second jumper 480*b* at a region between "12 o'clock direction" and "1 o'clock direction" (that is, "12-1 o'clock region"). The rotational center of the date star wheel 312 is arranged in "2 o'clock direction". The lower shaft portion of the date star wheel 312 is rotatably supported by the main plate 202. The date hand 312*h* is attached to the upper shaft portion of the date star wheel 312 (designated by a two-dotted chain line in FIG. 6).

(2.3) Structure of Day Display Mechanism:

Next, a structure of a day display mechanism will be explained. In reference to FIG. 23 and FIG. 24, in the movement 201D, the day indicator feeding mechanism is constituted to operate based on rotation of the hour wheel 262. The day indicator display mechanism includes the day indicator driving wheel 320, the day indicator transmission wheel 462, the small day indicator 464, the day jumper 468, the first hammer 491, the second hammer 492, and a second hammer return spring 494. The day indicator driving wheel 320 is constituted to rotate by rotation of the hour wheel 262. The day indicator driving wheel 320 is rotatably supported by the day indicator driving wheel pin 320*p* provided at the main plate 202. It is preferable to arrange the rotational center of the day indicator driving wheel 320 at a region between "10 o'clock direction" and "11 o'clock direction" (that is, "10-11 o'clock region"). The rotational center of the small day indicator 464 is arranged in "9 o'clock direction".

A position in the rotational direction of the day indicator transmission wheel 262 is constituted to be stopped by the day jumper 468 rotatably provided at the main plate 202. A day jumper pressing spring portion 480*c* provided at the back object holder 480 is constituted to press a stopping portion provided at a front end of the day jumper 468 to the wheel portion 462*b* of the date indicator transmission wheel 462. It is preferable to arrange a position of the stopping portion provided at the front end of the day jumper 468 at a region between "9 o'clock direction" and "10 o'clock direction" (that is, "9-10 o'clock region"). It is preferable to arrange a position of the day jumper pressing spring portion 480*c* at a region between "9 o'clock direction" and "11 o'clock direction" (that is, "9-11 o'clock region").

The first hammer 491 is rotatably supported by a hammer pin 466*p* provided at the main plate 202. The second hammer 492 is rotatably supported by the hammer pin 466*p* provided at the main plate 202. The first hammer 491 is provided with a cam contact portion 491*c* constituted to be brought in contact with a transmission cam portion 462*c*, a first operating-wheel portion 491*f* constituted to be brought in mesh with a day wheel portion 464*b*, and a second operating wheel portion 491*g*. The second operating wheel portion 491*g* is provided to be able to be brought in mesh with the day wheel portion 464*b* of the small day indicator 464. The second hammer 492 includes a hammer main body portion 492*b*, and a hammer wheel portion 492*c*. The hammer wheel portion 492*c* is constituted to be brought in mesh with the day wheel portion 464*b*. It is preferable to constitute a tooth shape of the first operating wheel portion 491*f* to be equal to a tooth shape of the second operating wheel portion 491*g*. It is preferable to constitute a tooth shape of the hammer wheel portion 492*c* to be equal to a tooth shape of the first operating wheel portion 491*f*. It is preferable to constitute a tooth shape of the hammer wheel portion 492*c* to be equal to a tooth shape of the second operating wheel portion 491*g*.

The first operating wheel portion 491*f* is constituted such that when the small day indicator 464 is arranged at a first position, the first operating wheel portion 491*f* can be brought in mesh with the day wheel portion 464*b* at the position. For example, the first position is arranged in "9 o'clock direction". Further, the second operating wheel portion 491*g* is constituted such that when the small day indicator 464 is arranged at a second position, the second operating wheel portion 491*g* can be brought in mesh with the day wheel portion 464*b* at the position. For example, the second position is arranged in "10 o'clock direction". The first operating wheel portion 491*f* and the second operating wheel portion 491*g* can be formed as first parts.

The second hammer 492 is constituted to receive a force of rotating in the clockwise direction always by the spring force of the return spring portion 494*c*. Therefore, the small day indicator 464 is constituted to receive always a force of rotating in the counterclockwise direction. Therefore, a front end portion of the cam contact portion 491*c* of the first hammer 491 is constituted to always receive a force of being pressed to the transmission cam portion 462*c* of the day indicator transmission wheel 462.

The first operating wheel portion 491*f* of the first hammer 491 can be constituted as a wheel with chipped teeth having an opening angle from 30 degrees to 80 degrees by constituting a reference by the rotational center. The second operating wheel portion 491*g* of the first hammer 491 can be constituted as a wheel with chipped teeth having an opening angle from 30 degrees to 80 degrees by constituting a reference by the rotational center. It is further preferable to constitute the first operating wheel portion 491*f* as a wheel with chipped teeth having an opening angle from 40 degrees to 60 degrees by constituting a reference by the rotational center. By the constitution, the small-sized first operating wheel portion 491*f* can be formed. It is further preferable to constitute the second operating wheel portion 491*g* as a wheel with chipped teeth having an opening angle from 40 degrees to 60 degrees by constituting a reference by the rotational center. By the constitution, the small-sized second operating wheel portion 491*g* can be formed.

It is preferable that an angle made by a center line of the opening angle of the first operating wheel portion 491*f* and a center line of the opening angle of the second operating wheel portion 491*g* by 90 degrees through 180 degrees. It is further preferable to constitute the angle made by the center line of the opening angle of the first operating wheel portion 491*f* and the center line of the opening angle of the second operating wheel portion 491*g* by 110 degrees through 140 degrees. By the constitution, the small sized hammer 491 can be formed. The hammer wheel portion 492*c* of the second hammer 492 can be constituted as a wheel with chipped teeth having the opening angle from 30 degrees to 80 degrees by constituting a reference by the rotational center. It is further preferable to constitute the hammer wheel portion 492*c* by a wheel with chipped teeth having an opening angle from 40 degrees to 60 degrees by constituting a reference by the rotational center. By the constitution, the small-sized hammer wheel portion 492*c* can be formed.

As a modified example, the operating wheel portion of the first hammer 491 may be constructed by a constitution including a teeth portion over an entire periphery. According to the constitution, the first operating wheel portion 491*f* is constituted as a portion of the entire periphery teeth portion, and the second operating wheel portion 491*g* is constituted as other portion of the entire periphery teeth portion. Or, the first operating wheel portion 491*f* may be constituted as a portion of a teeth portion of a wheel with chipped teeth the portion of which is chipped (for example, wheel with chipped teeth having an opening angle of 180 degrees) and the second operating wheel portion 491*g* may be constituted as other portion of the teeth portion of the wheel with chipped teeth the portion of which is chipped. As a modified example, the hammer wheel portion 492*c* of the second hammer 492 may be constructed by a constitution including a teeth portion over an entire periphery.

Figure 24:
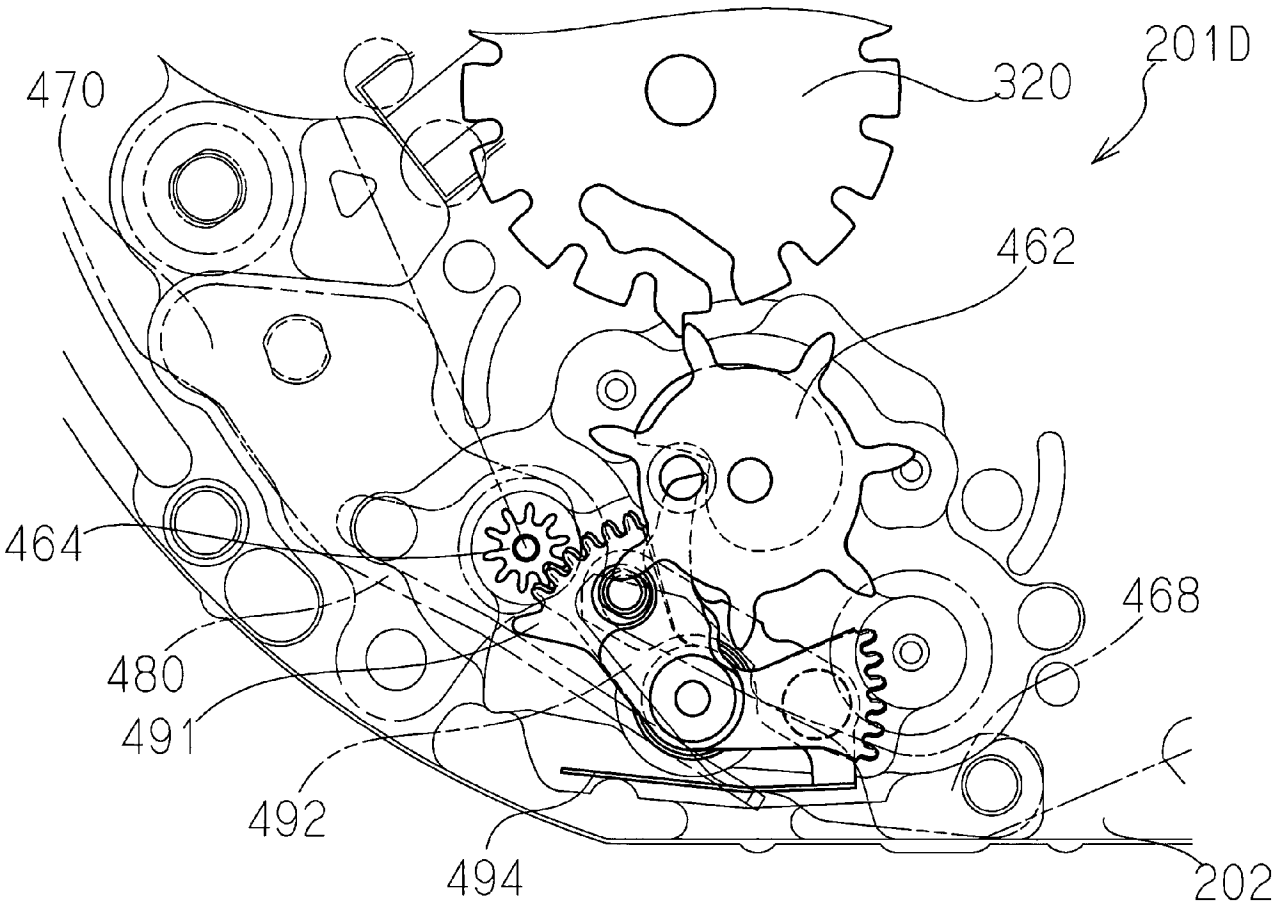
FIG. 24 is an enlarged partial plane view showing a structure of a day feeding mechanism in a state of displaying Sunday according to the second embodiment of the multifunction timepiece of the invention.

In reference to FIG. 24, the front end portion or a portion proximate to the front end portion of the return spring base portion 494*b* of the second hammer return spring 494 is brought into contact with a spring positioning wall portion provided at the main plate 202. By the spring force of the return spring portion 494*c*, the second hammer 492 always receives a force of rotating in the clockwise direction. Therefore, the small day indicator 464 receives a force of rotating in the counterclockwise direction. Therefore, the front end portion of the cam contact portion 491*c* of the first hammer 491 always receives a force of being pressed to the transmission cam portion 462*c* of the day indicator transmission wheel 462. In a state of indicating "Sun" representing "Sunday" by the small day indicator 464, the front end portion of the cam contact portion 491*c* of the first hammer 491 is pressed to a portion of the transmission cam portion 462*c* of the day indicator transmission wheel 462 proximate to a minimum radius portion.

In the movement 201D, the rotational center of the small day indicator 464 is arranged in "10 o'clock direction". The dial 454C is provided with characters, numerals, abbreviated characters for displaying days. Particularly, in reference to FIG. 27, information with regard to "day" constituting one of calendar information is constituted to be able to be displayed by a day hand 464*h* moved in a fan shape, characters, numerals, abbreviated characters or the like of the dial 454C.

(2.4) Structure of Date Correction Mechanism:

Next, a structure of a date correction mechanism will be explained. In reference to FIG. 22, and FIG. 23, the back side of the movement 201D is provided with a date correction mechanism for correcting display of date by the date star wheel 312. The date correction mechanism is constituted by the first corrector setting transmission wheel 351, the second corrector setting transmission wheel 352, the third corrector setting transmission 353, the fourth corrector setting transmission wheel 354 and the date corrector setting wheel 355. The rotational center of the second corrector setting transmission wheel 352 is arranged in "3 o' clock direction". The rotational center of the second corrector setting transmission wheel 352 according to the second embodiment of the multifunction timepiece of the invention is arranged to be the same as the rotational center of the third corrector setting transmission wheel 352 according to the first embodiment of the multifunction timepiece of the invention.

The third corrector setting transmission wheel 353 is rotatably supported by the main plate 202. It is preferable to arrange the rotational center of the third corrector setting transmission wheel 353 in "2 o'clock direction" or a region between "2 o'clock direction" and "3 o'clock direction" (that is, "2-3 o'clock region"). The rotational center of the third corrector setting transmission wheel 353 according to the second embodiment of the multifunction timepiece of the invention is arranged to be the same as the rotational center of the third corrector setting transmission wheel 353 according to the first embodiment of the multifunction timepiece of the invention. The lower shaft of the fourth corrector setting transmission wheel 354 is movably and rotatably supported by a second fourth corrector setting transmission wheel guide long hole provided at the main plate 202. It is preferable to arrange the second fourth corrector setting transmission wheel guide long hole for guiding the lower shaft of the fourth corrector setting transmission wheel 354 at a region between "1 o'clock direction" and "2 o'clock direction" (that is, "1-2 o'clock region"). The second fourth corrector setting transmission wheel guide long hole according to the second embodiment of the multifunction timepiece of the invention is arranged at a position more proximate to the outer shape portion of the main plate 202 than the fourth corrector setting transmission wheel guide long hole according to the first embodiment of the multifunction timepiece of the invention. A second correction spring portion 314*b*2 for pressing the fourth corrector setting transmission wheel 354 to the main plate 202 is provided at the date corrector setting transmission wheel holder 314. It is preferable to arrange the rotational center of the date corrector setting wheel 355 at a region between "12 o'clock direction" and "1 o'clock direction" (that is, "12-1 o'clock region").

(2.5) Structure of Main Plate:

Next, an explanation added to the above-described explanation of the first embodiment will be given of a structure of the main plate 202. In reference to FIG. 7, the main plate 202 further includes the rotational center 202DW2 of the date indicator driving wheel 310 according to the second embodiment, the rotational center 202DS2 of the date star wheel 312 according to the second embodiment, the rotational center 202 SW2 of the small day wheel 322 according to the second embodiment, and the rotational center of the rotating member by the rotational center 202SB2 of the date corrector setting wheel 355 according to the second embodiment.

Further, the main plate 202 includes the second fourth corrector setting transmission wheel guide long hole 202SL2 for movably guiding the lower shaft of the fourth corrector setting transmission wheel 354 according to the second embodiment. The above-described respective rotational centers are formed with guide shaft portions for guiding center holes of rotating members for rotatably supporting the rotating member rotated centering on the rotational centers, or formed with guide holes for guiding the shaft portions of the rotating members. That is, a train wheel guide portion can be constituted by a guide hole, a guide bearing, a guide shaft, a guide pin or the like for rotatably guiding the rotating member.

The rotational center of the first hammer 491, the rotational center of the second hammer 492 according to the second embodiment can be arranged at the positions the same as those of the rotational center of the first hammer 491, the rotational center 202WF of the second hammer 492 according to the first embodiment. As has been explained above, the main plate 202 includes the center pipe 202*b* arranged at the main plate center 202*c*, the lower bearing of the rotor 236, the lower bearing of the fifth wheel & pinion 238, the lower bearing of the fourth wheel & pinion 240, the lower bearing of the third wheel & pinion 242, the lower bearing of the minute wheel 260, the guide pin of the setting wheel 278, the guide pin of the date indicator driving wheel 310, the guide pin of the date star wheel 312, the guide pin of the day indicator driving wheel 320, the lower bearing of the small day wheel 464, the lower bearing of the hour indicator 330, the lower bearing of the second indicator 340, the guide pin of the third corrector setting transmission wheel 353, and the guide pin of the date corrector setting wheel 355. For example, the bearing can be constituted by a hole jewel, a mortise frame, a penetrated hole, a blind hole or the like. For example, the guide pin can be formed integrally with the main plate 202, or a pin formed separately from the main plate 202 can also be fixed to the main plate 202. Or, in place of the bearing, a guide member of a pin or the like can also be used. Or, in place of the guide pin, a guide member of a hole jewel, a mortise frame, a penetrated hole, a blind hole or the like.

The movement 201C, the movement 201D include the first train wheel rotational center for the train wheel used for fabricating the multifunction timepiece of the first type having an arrangement of the small hand of the first type, and the second train wheel rotational center for the train wheel used in fabricating the multifunction timepiece of the second type having the arrangement of the small hand of the second type. The first-train wheel rotational center, the second train wheel rotational center are provided with train wheel guide portions (guide hole, guide bearing, guide shaft, guide pin or the like) for rotatably guiding the train wheel members rotated centering on the positions. The first train wheel rotational center, the second train wheel rotational center are arranged at positions between the main plate center 202*c* of the main plate 202 and the main plate outer shape portion of the main plate 202. As has been explained above, according to the first embodiment and the second embodiment, the main plate 202 can be used in the movement 201C and can also be used in the movement 201D. By the constitution, various types of movements can efficiently be fabricated by utilizing the same parts.

(2.6) Structure of Date Corrector Setting Transmission Wheel Holder:

Next, an explanation added to the above-described explanation of the first embodiment will be given of a structure of the date corrector setting transmission wheel holder 314. In reference to FIG. 8, the date corrector setting transmission wheel holder 314 is provided with the second correction spring portion 314*b*2 for pressing the fourth corrector setting transmission wheel 354 to the main plate 202. It is preferable to arrange the correction spring portion 314*b*2 at a region between "1 o'clock direction" and "2 o'clock direction" (that is, "1-2 o'clock region"). It is preferable to arrange a front end portion of the second correction spring portion 314*b*2 brought into contact with the fourth corrector setting transmission wheel 354 at a region between "1 o'clock direction" and "2 o'clock direction" (that is, "1-2 o'clock region"). Further, it is preferable to constitute to narrow the portion of the date corrector setting transmission wheel holder 314 disposed on the lower side of the date star wheel 312 in the circular shape toward the back face of the of the main plate 202 and fit the hole provided at the center of the circular narrowed portion to the date corrector setting transmission wheel holder guide shaft portion provided at the surrounding of the date star wheel guide hole. As has been explained above, according to the first embodiment, the second embodiment, the date corrector setting transmission wheel holder 314 can be used in the movement 201C, further, can be used in the movement 201D.

(2.7) Structure of Back Object Holder:

Next, an explanation added to the above-described explanation of the first embodiment will be given of a structure of the back object holder 480. In reference to FIG. 9, the second jumper 480*b* for stopping the position in the rotational direction of the date star wheel 312 according to the second embodiment is provided at the back object holder 480. It is preferable to arrange the spring portion of the second date jumper 408*b* at the region between "1 o'clock direction" and "5 o'clock direction" (that is, "1-5 o'clock region"). It is preferable to arrange the stopping portion provided at the front end of the spring portion of the second date jumper 480*b* at a region between "12 o'clock direction" and o'clock direction" (that is, "12-1 o'clock region"). According to the second embodiment, the back object holder the same as the back object holder 480 used in the first embodiment of the multifunction timepiece of the invention can be used. That is, dimension and shape of the day jumper pressing spring portion 480*c* according to the second embodiment can be constituted to be the same as dimension and shape of the date jumper pressing portion 480*c* according to the first embodiment. As has been explained above, according to the first embodiment, the second embodiment, the back object holder 480 can be used in the movement 201*c*, further, can also be used in the movement 201D.

(2.8) Operation of Day Feeding Mechanism:

According to the second embodiment of the multifunction timepiece of the invention, operation of the day feeding mechanism is similar to that explained in the first embodiment. In reference to FIG. 22 and FIG. 24, in the state of indicating "Sun" representing "Sunday" by the day hand 464*h* and a character, a numeral, an abbreviated character or the like of the dial 454, the day indicator driving wheel 320 is rotated by rotation of the hour wheel 262. By rotating the day indicator transmission wheel portion 462*b* of the day indicator transmission wheel 462 by the day feeding claw 320*f* provided at the day indicator driving wheel 320, the day indicator transmission wheel 462 is rotated by once per day, (1/7). The position in the rotational direction of the day indicator transmission wheel 462 is stopped by the day jumper 468 provided rotatably at the main plate 202. The day jumper pressing spring portion 480*c* provided at the back object holder 480 presses the stopping portion provided at the front end of the day jumper 460 to the day indicator transmission wheel portion 462*b* of the day indicator transmission wheel 462.

The cam contact portion 491*c* of the first hammer 491 is brought into contact with the transmission cam portion 462*c*. The first operating wheel portion 491*f* of the first hammer 491 is brought in mesh with the day indicator wheel portion 464*b*. The hammer wheel portion 492*c* of the second hammer 492 is brought in mesh with the day indicator wheel portion 464*b*. The front end portion or the portion proximate to the front end portion of the return spring base portion 494*b* of the second hammer return spring 494 is brought into contact with the spring positioning wall portion provided at the main plate 202. By the spring fourth of the return spring portion 494*c*, the second hammer 492 always receives a force of rotating in the clockwise direction. Therefore, the small day indicator 464 always receives the force of rotating in the counterclockwise direction. Therefore, the front end portion of the cam contact portion 491*c* of the first hammer 491 always receives the force of being pressed to the transmission cam portion 462*c* of the date indicator transmission wheel 462. In the state of indicating "Sun" representing "Sunday" by the small day indicator 464, the front end portion of the cam contact portion 491*c* of the first hammer 491 is pressed to the portion of the transmission cam portion 462*c* of the day indicator transmission wheel 462 proximate to the minimum radius portion.

Figure 25:
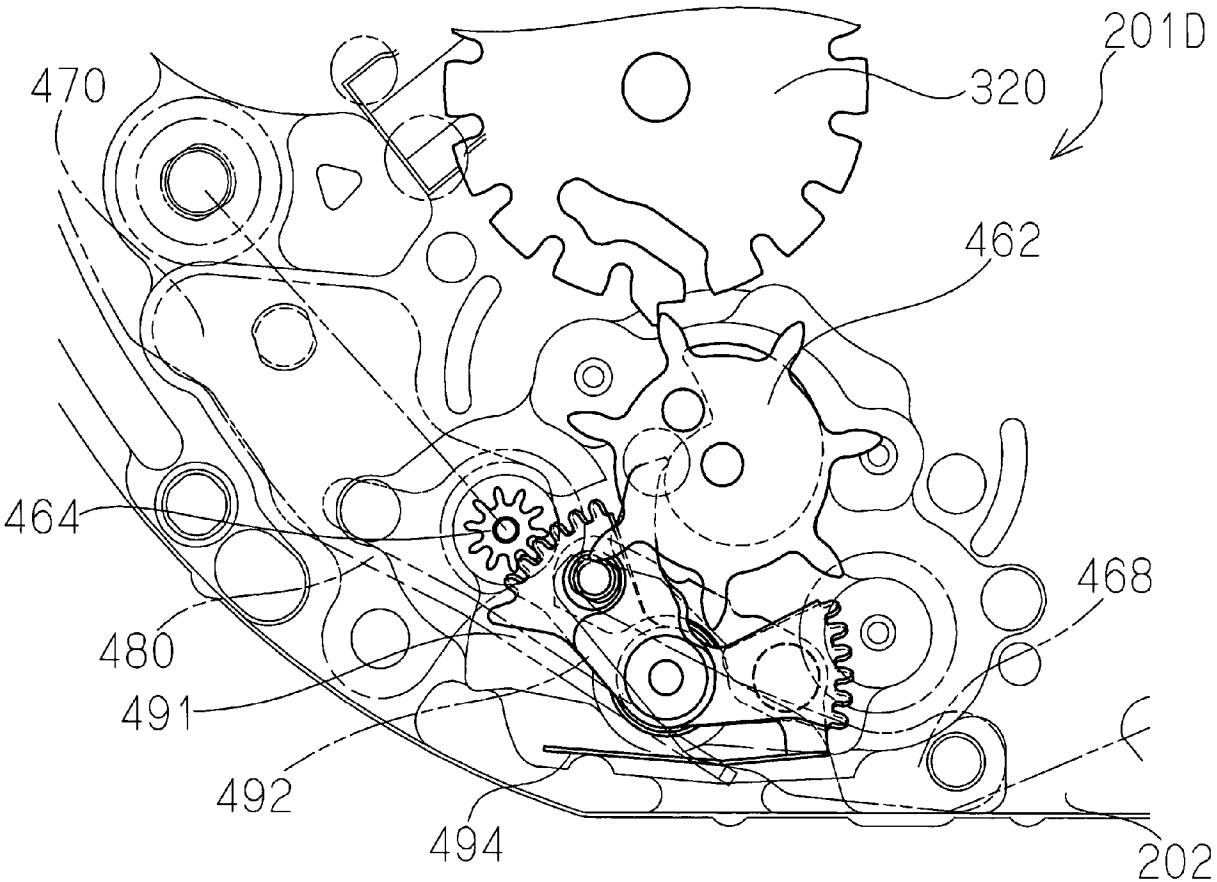
FIG. 25 is an enlarged partial plane view showing the structure of the day feeding mechanism in a state of displaying Monday according to the second embodiment of the multifunction timepiece of the invention.

Next, in reference to FIG. 25, when the day indicator transmission wheel portion 462*b* of the day indicator transmission wheel 462 is rotated by one day, that is, (1/7) by the day indicator feeding claw 320*f* from the state of indicating "Sun" representing "Sunday" shown in FIG. 24 by rotating the hour wheel 262, the first hammer 491 is rotated by one day from the state of indicating "Sun". The position in the rotational direction of the day indicator transmission wheel 462 is stopped by the day jumper 468 rotatably provided at the main plate 202. The first operating wheel portion 491*f* of the first hammer 491 rotates the small day indicator 464 by one day to be brought into a state of indicating "Mon" representing "Monday". By the spring force of the return spring portion 494*c*, the small day indicator 464 always receives the force of rotating in the counterclockwise direction via the second hammer 492. The first hammer 491 always receives the force of rotating in the clockwise direction. The front end portion of the cam contact portion 491*c* of the first hammer 491 receives the force of being pressed to the transmission cam portion 462*c* of the day indicator transmission wheel 462. Similarly, it is possible that everyday, the small day indicator 464 is rotated by one day, brought into a state of indicating "Tue" representing "Tuesday" from the state of indicating "Mon" representing "Monday", next, brought into a state of indicating "Wed" representing "Wednesday", next, brought into a state of indicating. "Thu" representing "Thursday", next, brought into a state of indicating "Fri" representing "Friday", next, brought into a state of indicating "Sat" representing "Saturday", further, changed into a state of indicating "Sun" representing "Sunday".

Figure 26:
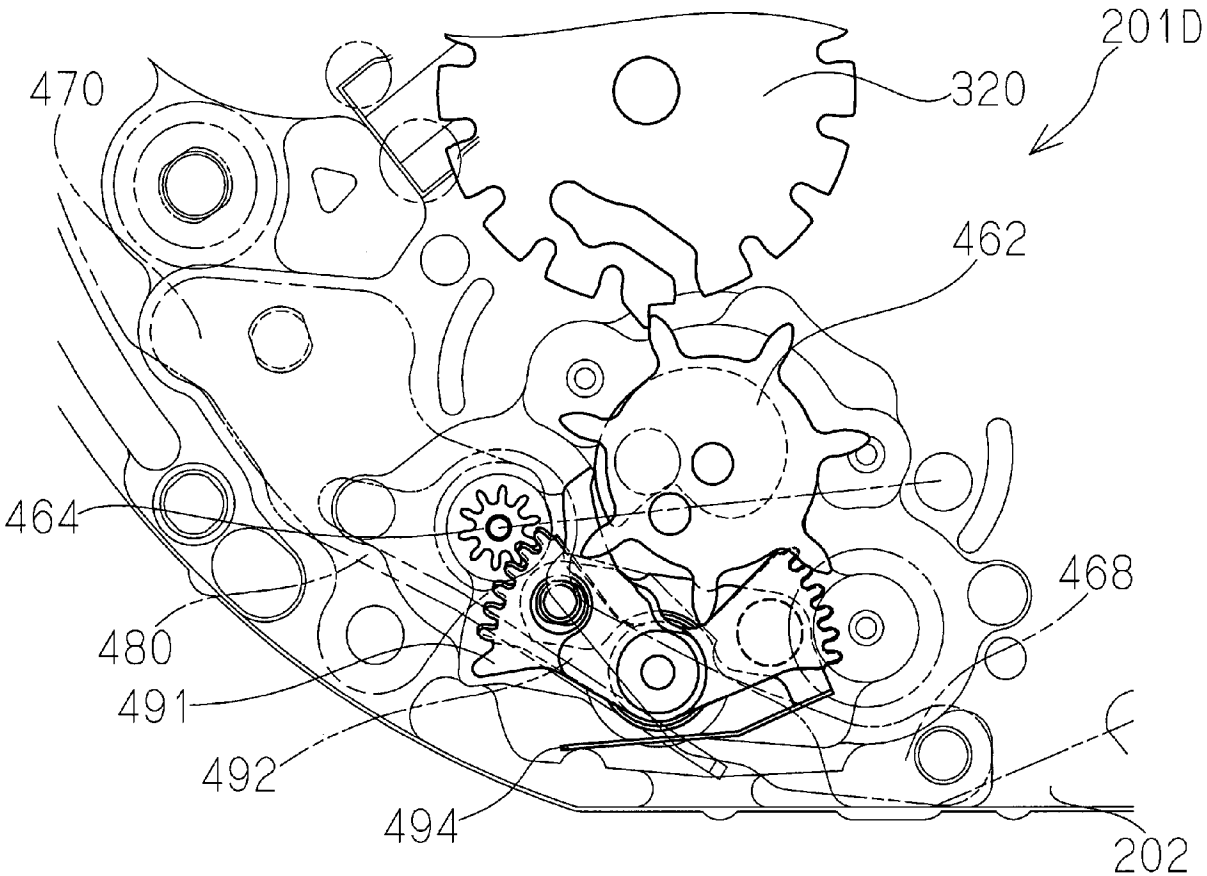
FIG. 26 is an enlarge partial plane view showing the structure of the day feeding mechanism in a state of displaying Saturday according to the second embodiment of the multifunction timepiece of the invention.

In reference to FIG. 26, in the state of indicating "Sat" representing "Saturday" by the small day indicator 464, the front end portion of the cam contact portion 491*c* of the first hammer 491 is pressed to the portion of the transmission cam portion 462*c* of the day indicator transmission wheel 462 proximate to the maximum radius portion. When in the state of indicating "Sat" representing "Saturday", by rotation of the hour wheel 262, the day indicator transmission wheel portion 462*b* of the day indicator transmission wheel 462 is rotated by one day, that is, (1/7) by the day indicator feeding claw 320*f*, the front end portion of the cam contact portion 491.*c* of the first hammer 491 is moved from the portion of the transmission cam portion 462*c* of the day indicator transmission wheel 462 proximate to the maximum radius portion and is pressed to the portion of the transmission cam portion 462*c* of the day indicator transmission wheel 462 proximate to the minimum radius portion.

Figure 27:
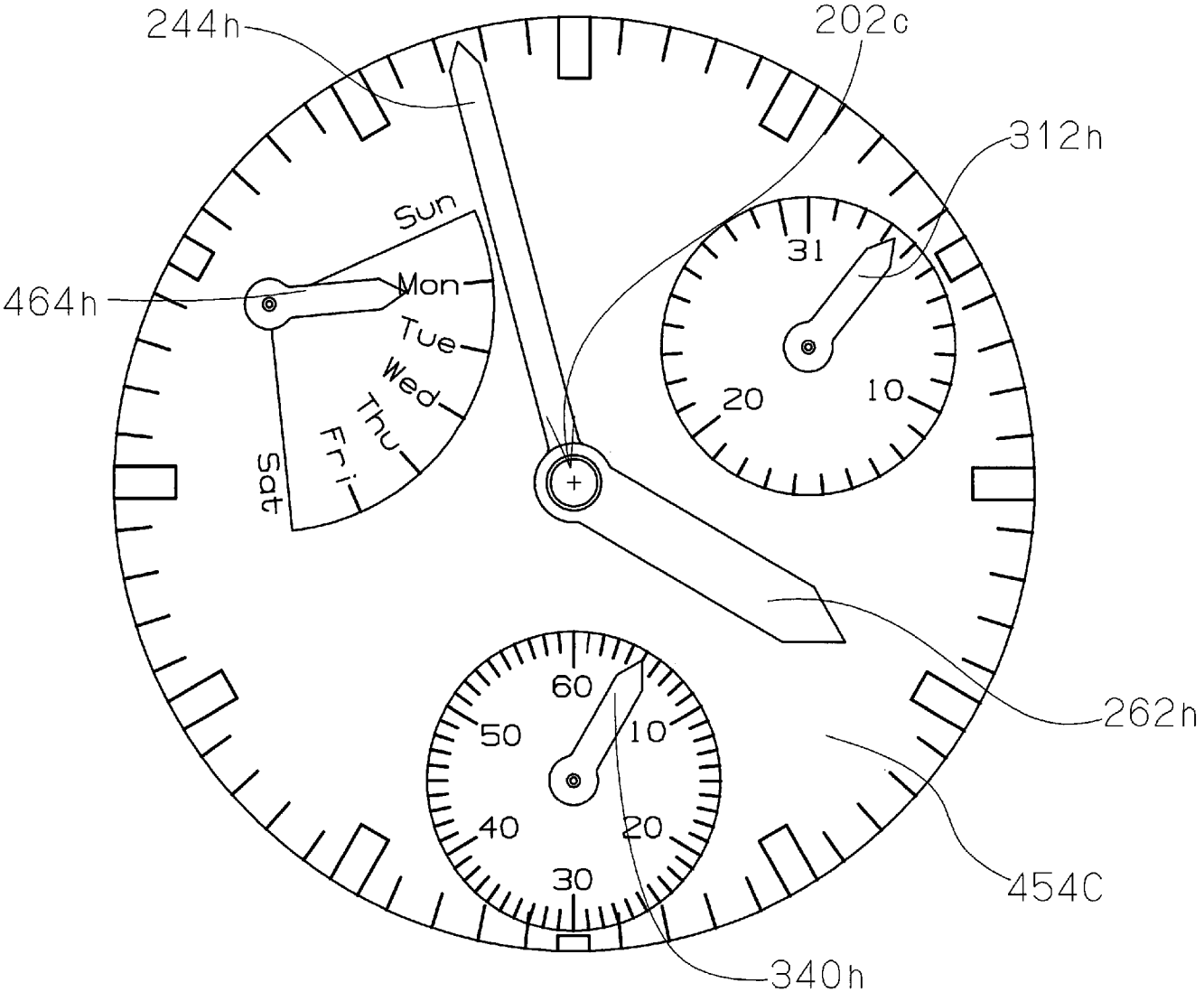
FIG. 27 is a plane view showing a dial and portions of hands of a complete having three small hands according to the second embodiment of the multifunction timepiece of the invention.

(2-9) Explanation of Hand Position and Hand Specification:

In reference to FIG. 10: and FIG. 27, in a third kind of the embodiment of the multifunction timepiece, it is possible that by the hour hand 262*h* attached to the hour wheel 262 the rotational center of which is the main plate center 202*c*, time information with regard to "hour" of the 12 hour system is displayed, time information with regard to "minute" is displayed by the minute hand 244*h* attached to the center wheel & pinion 244 the rotational center of which is the main plate center 202*c*, by the small second hand 340*h* attached to the second indicator 340 the rotational center of which is arranged in "6 o'clock direction", time information with regard to "second" is displayed, by the date hand 312*h* attached to the date star wheel 312 the rotational center of which is arranged in "2 o' clock direction", calendar information with regard to "date" is displayed, by the date hand 464*h* attached to the small day indicator 464 the rotational center of which is arranged in "10 o'clock direction" and capable of moving in a fan shape, calendar information with regard to "day" is displayed by so-to-speak "retrograde type". For example, the day hand 464*h* can display calendar information with regard to "day" in a range of 90 degrees through 160 degrees. In view of allowance of design of constituent parts and design performance of day display, it is preferable that the day hand 464*h* displays calendar information with regard to "day" in a range of 100 degrees through 120 degrees.

It is preferable to constitute to equalize the distance from the main plate center 202*c* to the rotational center of the date hand 312*h*, the distance from the main plate center 202*c* to the rotational center of the small second hand 340*h*, and the distance from the main plate center 202*c* to the rotational center of the 24 hour hand 330*h*. However, the distances between the centers can also be constituted not to be equal to each other. It is preferable to constitute the distance from the main plate center 202*c* to the rotational center of the day hand 464*h* larger than the distance from the main plate center 202*c* to the rotational center of the date hand 312*h*. It is preferable to constitute the distance from the main plate center 202*c* to the rotational center of the day hand 464*h* larger than the distance from the main plate center 202*c* to the rotational center of the small second hand 340*h*.

The dial 454C is provided with characters, numerals, abbreviated characters or the like for displaying respective time information, calendar information. For example, in order to display calendar information with regard to "date", numerals of "10", "20", "31" are provided along a circumference at positions in correspondence with the date hand 312*h* of the dial 454C. For example, in order to display time information with regard to "second", numerals of "10", "20", "30", "40", "50", "60" are provided on a circumference at positions in correspondence with the small second hands 340*h* of the dial 454C. For example, in order to display calendar information with regard to "day", English letters of "Sun", "Mon", "Tue", "Wed", "Thu", "Fri", "Sat" are provided along a circumference at positions in correspondence with the day hand 464*h* of the dial 454C. Or, in order to display calendar information with regard to "day", numeral, Japanese letters, foreign language letters, Roman numerals, signs or the like can also be used.

(3) Fan Shape Moving Hand Train Wheel Apparatus

Further, by using the above-described fan shape moving hand train wheel used in the day feeding mechanism of the invention, the fan shape moving hand train wheel apparatus constituted to be able to display information by the small hand moved in a fan shape can be realized. The fan shape moving hand train wheel apparatus can be constituted to include the day indicator driving wheel 320, the day indicator driving transmission wheel 462, the small day indicator 464, the day jumper 468, the first hammer 491, the second hammer 492, and the second hammer return spring 494. The day indicator driving transmission wheel 462 is provided with the day indicator transmission wheel portion and the transmission cam portion 462*c*. The day indicator driving transmission wheel 462 is provided with the day transmission wheel portion and the transmission cam portion 462*c*. The transmission cam outer peripheral portion is constituted by the shape proximate to the cam face of so-to-speak "pivoting cam". The day hand 464*h* is attached to the hand attaching portion 464*g* of the small day indicator 464. The day jumper pressing spring portion 480*c* is constituted to press the stopping portion provided at the front end of the day jumper 468 to the day transmission wheel portion 462*b* of the day indicator driving transmission wheel 462. The first hammer 491 includes the cam contact portion 491*c* constituted to be brought into contact with the transmission cam portion 462*c*, the first operating wheel portion 491*f* constituted to be brought in mesh with the day indicator wheel portion 464*b*, and the second operating wheel portion 491*g*. The second hammer 492 includes the hammer main body portion 492*b* and the hammer wheel portion 492*c*. The hammer wheel portion 492*c* is constituted to be brought in mesh with the day indicator wheel portion 464*b*.

The second hammer 492 is rotatably provided in corporation with the small day indicator 464. The second hammer return spring 494 includes the return spring base portion 494*b* and the return spring portion 494*c*. The return spring base portion 494*b* of the second hammer return spring 494 is fixed to the second hammer 492. The front end portion or the portion proximate to the front end portion of the return spring base portion 494*b* is constituted to be brought in mesh with the spring positioning wall portion. Particularly in reference to FIG. 19, the second hammer 492 is constituted to always receive the force of rotating in the clockwise direction by the spring force of the return spring portion 494*c*. Therefore, the small day indicator 464 is constituted to always receive the force of rotating in the counterclockwise direction. Therefore, the front end portion of the cam contact portion 491*c* of the first hammer 491 is constituted to always receive the force of being pressed to the transmission cam portion 462*c* of the day indicator transmission wheel 462. By adjusting the rotational speed, the period, the speed reducing ratio or the like of the driving apparatus for operating the fan shape moving hand train wheel apparatus, by using the above-described fan shape moving hand train wheel apparatus, time information ("hour", "minute" and the like), information of display of date, display of day, display of month, display of year, display of lunar phase or the like can be displayed to be easy to see by the small hand moved in the fan shape.

By the invention, a plurality of movement layouts having fan shape moving hand mechanisms can be realized by only changing a position of integrating a part without changing a dimension and a shape of the part of the movements. Further, by the invention, an analog multifunction timepiece which is constituted to display calendar to be easy to see, small-sized, facilitated to fabricate and having a small hand can be realized. Further, by the invention, the fan shape moving hand train wheel apparatus capable of displaying information to be easy to see by the small hand and constituted to be small-sized and such that much time period is not needed in operation of fabricating and integrating parts can be realized.

The multifunction timepiece of the invention adopts the fan shape moving hand mechanism having a simple structure and therefore, much time period is not needed in operation of working and integrating parts. Further, the fan shape moving hand mechanism of the multifunction timepiece of the invention is small-sized, does not require much space and can firmly be operated. Further, by using the invention, the fan shape moving hand train wheel apparatus capable of displaying information to be easy to see by the small hand moved in the fan shape can be fabricated.

What is claimed is:

1. A multifunction timepiece comprising:

a main plate constituting a base plate of a movement;

a hand setting stem for correcting display;

a switching mechanism for switching a position of the hand setting stem;

a dial for displaying time information, and a small hand for displaying time information or calendar information;

a calendar information display mechanism constituted to be able to display the calendar information by the small hand moved in a fan shape;

wherein the calendar information display mechanism comprising:

a transmission wheel constituted to rotate based on rotation of an hour wheel and having a transmission cam portion;

a display wheel constituted to rotate based on rotation of the transmission wheel and for displaying the calendar information;

a first hammer rotatably provided by being brought into contact with the transmission cam portion; and a second hammer rotatably provided in corporation with the display wheel;

wherein the first hammer includes a cam contact portion and an operating wheel portion; and wherein the second hammer is constituted to always receive a force of rotating in a constant direction.

2. A multifunction timepiece according to claim 1, wherein the first hammer includes the cam contact portion and the operating wheel portion;

wherein the cam contact portion of the first hammer is constituted to be brought into contact with a cam outer peripheral portion of the transmission cam portion;

wherein the operating wheel portion of the first hammer is constituted to be brought in mesh with a wheel portion of the display wheel; and wherein a hammer wheel portion of the second hammer is constituted to be brought in mesh with the wheel portion of the display wheel.

3. A multifunction timepiece according to claim 1, wherein the force of always rotating the second hammer in the constant direction is exerted by a spring force of a second hammer return spring fixed to the second hammer.

4. A multifunction timepiece according to claim 1, wherein the operating wheel portion of the first hammer is constituted as a wheel with chipped teeth having an opening angle of 30 degrees through 80 degrees by constituting a reference by a rotational center of the first hammer.

5. A multifunction timepiece according to claim 1, wherein the hammer wheel portion of the second hammer is constituted as a wheel with chipped teeth having an opening angle of 30 degrees through 80 degrees by constituting a reference by a rotational center of the second hammer.

6. A fan shape moving hand train wheel apparatus constituted to be able to display information by a small hand comprising:

a transmission wheel having a transmission cam portion;

a display wheel constituted to rotate based on rotation of the transmission wheel and for displaying the information;

a first hammer rotatably provided by being brought into contact with the transmission cam portion; and a second hammer rotatably provided in corporation with the display wheel;

wherein the first hammer includes a cam contact portion and an operating wheel portion; and wherein the second hammer is constituted to always receive a force of rotating in a constant direction.

7. A fan shape moving hand train wheel apparatus according to claim 6, wherein the first hammer includes a cam contact portion and an operating wheel portion;

wherein the cam contact portion of the first hammer is constituted to be brought into contact with a transmission cam outer peripheral portion of the transmission cam portion;

wherein the operating wheel portion of the first hammer is constituted to be brought in mesh with a wheel portion of the display wheel; and wherein a hammer wheel portion of the second hammer is constituted to be brought in mesh with the wheel portion of the display wheel.

8. A fan shape moving hand train wheel apparatus according to claim 6, wherein the force of always rotating the second hammer in the constant direction is exerted by a spring force of a second hammer return spring fixed to the second hammer.

9. A fan shape moving hand train wheel apparatus according to claim 6, wherein the operating wheel portion of the first hammer is constituted as a wheel with chipped teeth having an opening angle of 30 degrees through 80 degrees by constituting a reference by a rotational center of the first hammer.

10. A fan shape moving train wheel apparatus according to claim 6, wherein the hammer wheel portion of the second hammer is constituted as a wheel with chipped teeth having an opening angle of 30 degrees through 80 degrees by constituting a reference by a rotational center of the second hammer.

* * * * *